US005917513A

United States Patent [19]

Miyauchi et al.

[11] Patent Number: 5,917,513

[45] Date of Patent: Jun. 29, 1999

[54] INK JET RECORDING APPARATUS WITH RECOVERY PUMP OPERATED BY MOVEMENT OF CARRIER

[75] Inventors: Yasuo Miyauchi, Machida; Yoichi Tosaka, Yokohama, both of Japan

[73] Assignee: Canon Kabushiki Kaisha, Tokyo, Japan

[21] Appl. No.: 08/423,106

[22] Filed: Apr. 18, 1995

[30] Foreign Application Priority Data

Apr. 20, 1994 [JP] Japan ..... 6-082045
Jul. 15, 1994 [JP] Japan ..... 6-164432

[51] Int. Cl.[6] ..... B41J 2/165

[52] U.S. Cl. ..... 347/29; 347/30

[58] Field of Search ..... 347/30, 85, 29, 347/31, 32, 37, 84; 417/476, 474, 415, 477.3, 477.8

[56] References Cited

U.S. PATENT DOCUMENTS 5,262,804 11/1993 Petigrew et al. ..... 347/54
5,325,111 6/1994 Dietl ..... 347/30

FOREIGN PATENT DOCUMENTS 0398348 11/1990 European Pat. Off. .
0423475 4/1991 European Pat. Off. .
3005160 1/1991 Japan .
3-193461 8/1991 Japan .
403246040 11/1991 Japan ..... 347/104
5069558 3/1993 Japan .
0006839 6/1994 Switzerland ..... 347/30

*Primary Examiner*—Benjamin R. Fuller
*Assistant Examiner*—Thien Tran
*Attorney, Agent, or Firm*—Fitzpatrick, Cella, Harper & Scinto

[57] ABSTRACT

An ink jet recording apparatus has a movement mechanism for moving a recording head mounted thereon for recording by discharging ink through discharge ports, and a recovery device for recovering or maintaining the discharge condition of the ink through the discharge ports. The recovery device includes a cap for capping the discharge ports, and a pump for causing pressure changes to expel the ink into the cap through the discharge ports, utilizing the movement of the movement mechanism.

7 Claims, 22 Drawing Sheets

| |
|---|
| FIG. 24A |
| FIG. 24B |
| FIG. 24C |

INK JET RECORDING APPARATUS WITH RECOVERY PUMP OPERATED BY MOVEMENT OF CARRIER

BACKGROUND OF THE INVENTION

1. Field of the Invention

The present invention relates to an ink jet apparatus for performing the recording or printing (hereinafter typically referred to as the "recording") of characters, symbols or images (hereinafter typically referred to as the "image") by discharging the ink or functional liquid (hereinafter typically referred to as the "ink") onto the recording carrier including papers, plastic sheets, cloths, and articles (hereinafter typically referred to as the "paper"). It is meant that the ink jet apparatus referred to in the present invention may be in a variety of forms, in addition to those provided integrally or separately as the output terminal for the information processing equipment such as a wordprocessor or a computer, including a copying machine combined with an information reader, a facsimile apparatus having the information transmission and reception feature, and an equipment for textile printing onto the cloths.

2. Related Background Art

In the so-called ink jet recording apparatus which performs the printing by ejecting the ink as droplets from discharge ports onto the recording medium, pump means may be provided to expel the ink through nozzles in a head having caused a problem such as dirt mixing or drying, or fill the ink from an ink reservoir into the discharge ports before starting the printing. This pump means is represented by a piston pump having reciprocal motion of a piston as disclosed in Japanese Laid-open Patent Application No. 3-5160, and a tube pump of stroking an elastic tube with a roller as disclosed in Japanese Laid-open Patent Application No. 5-69558. The piston pump can be generally miniaturized, but has the technical difficulty in retaining the air-tightness with a sliding piston member, as well as the necessity of employing a seal member such as an O-ring to form the sealing construction, thereby tending to have too many components. On the other hand, the tube pump can retain the air-tightness with the tube itself, and is capable of flowing the ink always in one direction by stroking the tube unidirectionally, so that pump means can be constituted less expensively, but the tube length is required, amounting to the volume of content corresponding to a pump capacity, resulting in a tendency that the entire apparatus becomes larger.

Conventionally, there are following systems for driving such a pump:

1) The user manually makes the pumping as required, interlocked with an operation member.

2) A dedicated motor is provided to drive the pump.

3) A clutch mechanism is provided to connect the motor to the pump only in pumping, wherein a motor for feeding the recording medium in sub-scan direction (hereinafter referred to as a "paper feed motor") or a motor for driving the head in main scan direction (hereinafter referred to as a "carrier motor") is also utilized as a driving source.

However, the above-described conventional driving systems had the following problems.

In example 1), because of the manual operation, there are drawbacks that the pumping speed may not be stabilized to apply a predetermined pressure to the recording head, or the user can not know whether the pumping is necessary or not until the confirmation of print failure, or the operation is cumbersome.

In example 2), the pumping device as such becomes larger by the installment of a dedicated motor, and has the higher cost.

In example 3), there is also a drawback that the apparatus is inevitably complicated. This point is explained below.

For the intrinsic purpose of each motor, namely, the driving of a paper feeding roller to feed the paper for a paper feeding motor, or the driving of a carrier for a carrier motor, the control thereof is required to be very highly precise. Accordingly, it is desirable that a drive transmission system between the motor and the paper feeding roller or carrier as the driven member does not have the connection cut off. However, when driving the motor for other purposes than the intrinsic purpose, the paper feeding roller or carrier will also move. In general, in most serial printers, a carrier motor is directly connected via a belt to the carrier. In this case, the employment of the carrier motor for other purposes is difficult due to the following reasons. First, the amount of rotation of the motor in one direction is only limited to the amount of stroke over which the carrier scans. Secondly, particularly when used as a driving source for pumping, the recording head will move during the pumping, so that the connection between the pump and the recording head is difficult. Accordingly, in such printers, a paper feeding motor is used as the driving source for other purposes, in place of the carrier motor. However, an ink jet printing apparatus must usually make, besides the pumping, at least the picking-up of the recording sheet with a cut sheet feeder, wherein their operation timings are necessary to be different, so that two clutch mechanisms which can be controlled at least independently are required. Further, in order to control the clutch mechanism independently, the following mechanisms are required:

A) A solenoid or an electromagnetic clutch is used to disconnect any gear train from the motor owing to electromagnetic force.

B) A carrier is used as a selector. Namely, if the carrier is moved to a certain position, a planetary gear is forced to mesh with the gear train from the motor, whereby the carrier is mechanically associated in phase with the clutch mechanism, such that the paper feeding motor is driven to perform any task while the clutch is being connected.

C) Supposing that the direction of rotating the paper feeding roller for the feeding of the recording medium is forward, a oneway clutch is provided for transmitting a rotational force only when it is inversely rotated.

Mechanism A) takes as much cost as if a dedicated motor is installed.

Mechanism B) has a drawback that the apparatus becomes larger because the carrier must be additionally moved out of the print zone by the number of clutch mechanisms.

Mechanism C) is a simple and less costly but only allows for the allocation of one task except for the paper feeding.

As above described, conventionally, many tasks were allocated to the paper feeding motor, so that the apparatus became larger and complicated, and therefore had higher costs.

Also, when a conventional tube pump is adopted, there is a drawback that the pump itself becomes larger, as previously described. For example, as disclosed in Japanese Laid-open Patent Application No. 5-69558, when the tube is disposed in arcuate shape, and if the inner diameter of the tube is 2 mm and the pump capacity is 0.3 ml, the length of the tube is equal to 95.5 mm by dividing the pump capacity by the cross sectional area of the tube. Further, if the arcuate section of the tube is exactly semicircular, the diameter of its circle is equal to 95.5×2/3.14, i.e., 60.8 mm. This is considerably a larger size for the ordinary serial printer.

Referring to FIG. 1, suction recovery means using a tube pump will be described in greater detail. This suction recovery means can suck the ink by stroking a tube with a roll to produce a negative pressure (see FIG. 1). That is, a tube 301 is disposed on a base 300 of which the surface is cut out in arcuate shape, and stroked with a roll provided on the peripheral rim of a disk 302 by rotating the disk 302 having its peripheral surface placed facing closely an arcuate cut-out portion. Also, a cap holder 305 to which a rubber cap 304 is attached is movably constituted, and shifted to a capping position when a recording head 306 comes to a predefined position. That is, by rotating the disk 302 in the state where the recording head 306 is capped with the cap 304, the ink is sucked from the recording head, together with the adhering matter around discharge ports.

Although duplicated with previously described ones, the problems with conventional suction recovery means of such a constitution are summarized as below.

(1) To say nothing of the cases of providing a dedicated motor to drive the tube pump, in the cases where the driving of tube pump is taken from a driving source for the paper conveying roller, reverse flow preventing means for preventing the reverse flow of the ink, or drive transmission switching means, may be required, leading to the increased cost.

(2) In order to assure the amount of ink suction necessary and sufficient to recover an ink jet head clogged, it is necessary to control the amount of stroking the tube 301 by recognizing the position of the roll 303. Also, if the tube 301 is blocked when the ink jet head 306 is capped, a positive pressure may instantaneously occur to cause the ink within the nozzles to flow back toward a supply chamber, in some instances, whereby the recognition of the roll position is also required. Thus, for example, sensing means 307 such as a photo-sensor as shown in FIG. 11 is required, also becoming a factor of the increased cost.

SUMMARY OF THE INVENTION

It is an object of the present invention to solve the above-mentioned problems and to provide an ink jet recording apparatus capable of forming a high quality image stably at all times by effecting a stable suction recovery operation with suction recovery means comprised of a tube pump with a simple construction, without causing any troubles such as the reverse flow.

It is another object of the present invention to provide an ink jet recording apparatus capable of driving a pump with a simple mechanism movable in accordance to the movement of a carrier, whereby a paper feeding system is simplified to reduce the size and cost of the apparatus, and the pump equipped with a flexible member such as a tube can be adopted, with its disposition space suppressed to a smaller dimension.

It is a further object of the present invention to provide an ink jet recording apparatus having movement means for moving, mounted with recording means for making the recording by discharging the ink through discharge ports, and recovery means for recovering and maintaining the discharge condition of the ink through said discharge ports, characterized in that said recovery means comprises a cap for capping over said discharge ports, and a pump for causing pressure changes expelling the ink into said cap through said discharge ports utilizing the movement of said movement means.

It is a still further object of the present invention to provide an ink jet recording apparatus comprising:

a carriage for mounting recording means for making the recording by discharging the ink through discharge ports;

a carrier for moving said carriage, said carrier being coupled with and separated from said carriage;

a cap for capping said discharge ports;

a flexible tube extending along a movement direction of said carrier in communication with said cap; and pressing means, provided on said carrier, for causing pressure changes within said cap by pressing said tube using the movement of said carrier.

According to the present invention, it is always possible to perform a suction recovery operation constantly at all times without needs of any special sensing means. Also, it is possible to prevent the reverse flow of the ink without having to increase the number of components. Accordingly, it is possible to provide an ink jet recording apparatus capable of always forming a stable, high quality image, wherein the occurrence of degraded image quality due to faulty ink discharging can be suppressed.

Also, since the carrier and the carriage are configured to be connectable and separable, and the pumping operation for the ink discharging is effected by a pressure portion pressing a flexible member of pumping means, interlocked with the movement of the carrier, the pumping operation for the ink discharging is enabled by moving the carrier separated from the carriage, while an ink jet head is connected to the pumping means at a predetermined position, whereby pumping means can be driven using a driving source of the carrier.

Further, since the pressure portion can be moved in accordance with a movement direction of the carrier, and with its movement, pumping means can be actuated at a predetermined timing, the driving of the carrier and that of pumping means can be effected at any timing, using a driving source of the carrier.

DETAILED DESCRIPTION OF THE PREFERRED EMBODIMENTS

Figure 1:
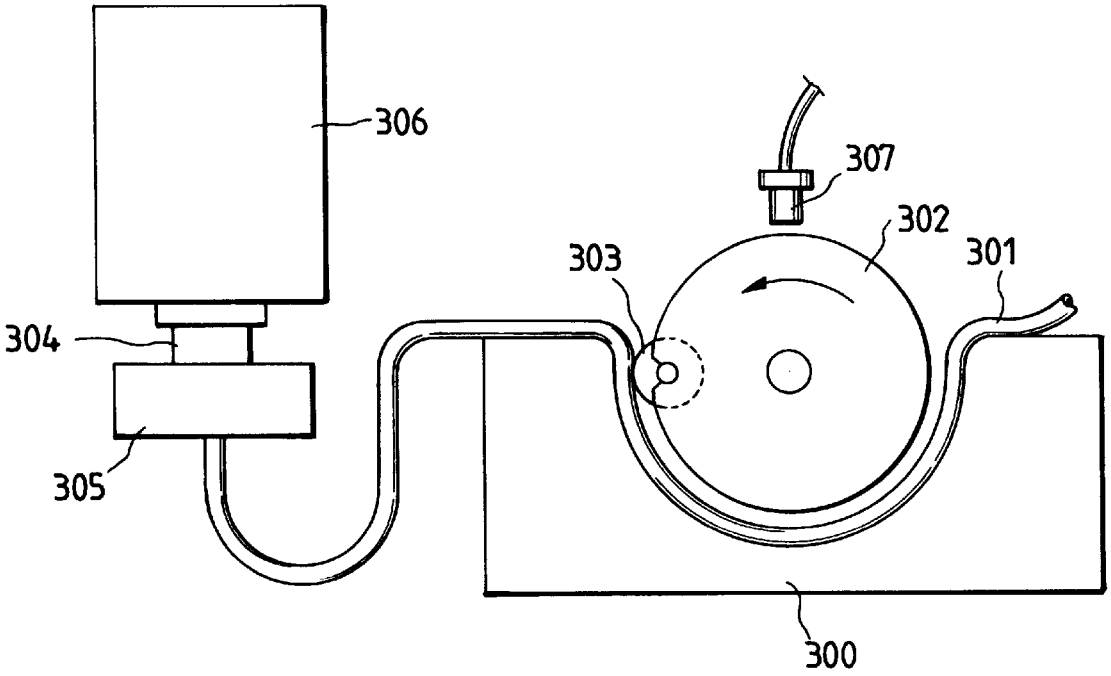
FIG. 1 is a typical plan view for explaining the schematic constitution of a recording head recovery system of a conventional ink jet recording apparatus, and particularly showing a suction pump.
Figure 2:
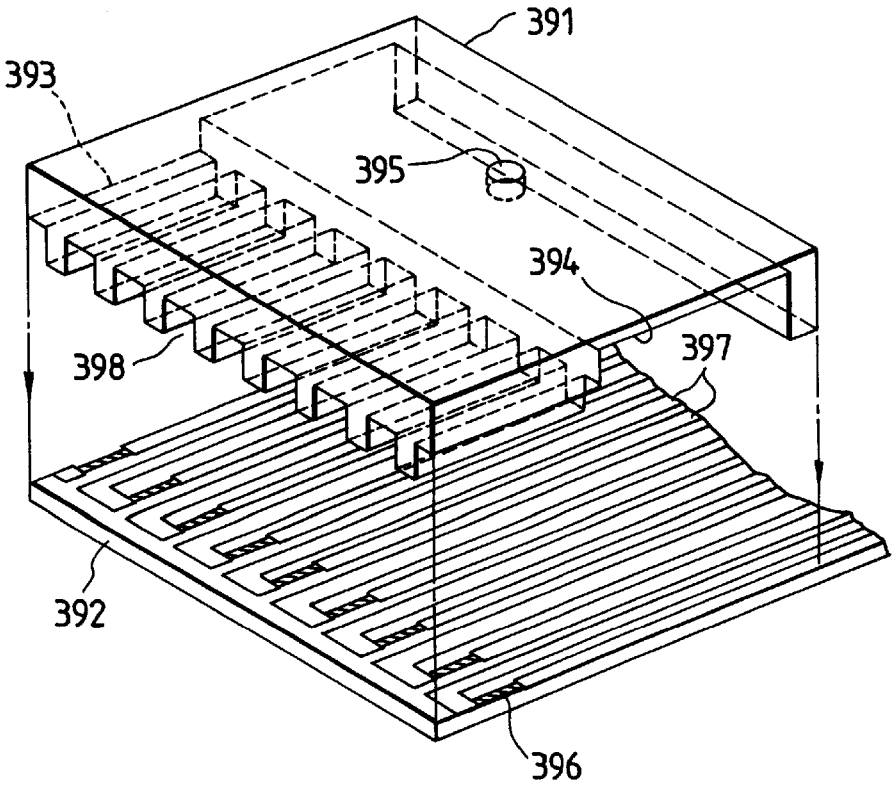
FIG. 2 is a typical perspective view for explaining the schematic constitution of the essence of a typical example of a recording head which is mounted on the ink jet recording apparatus.
Figure 3:
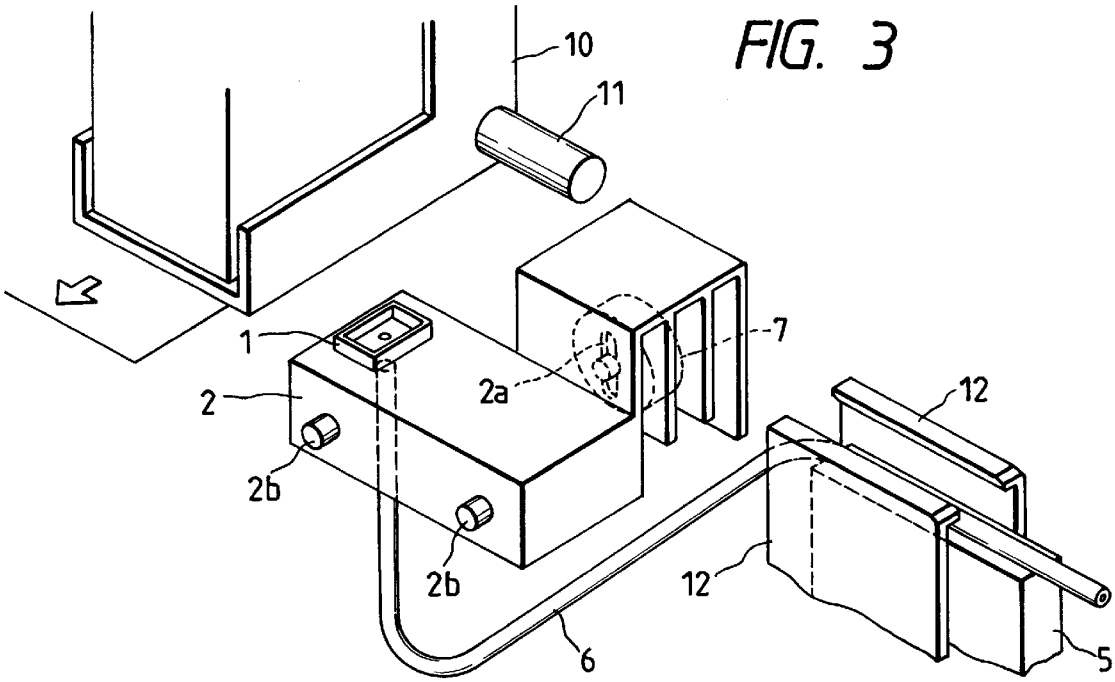
FIG. 3 is a perspective view for explaining the schematic constitution of a recording head recovery system of an ink jet recording apparatus based on a first example of the present invention.
Figure 4:
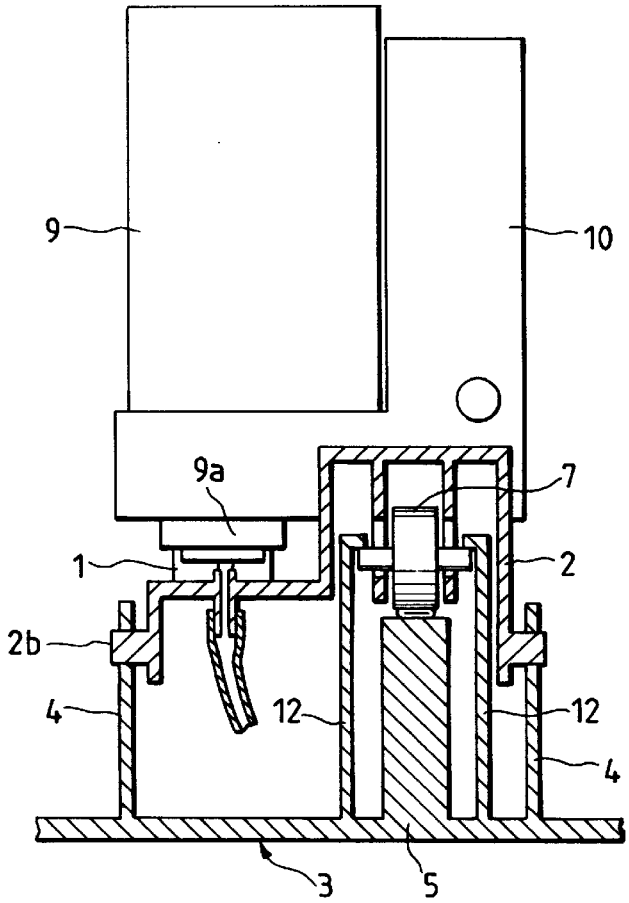
FIG. 4 is a cross-sectional view for explaining the schematic constitution of the recording head recovery system of the ink jet recording apparatus based on the first example of the present invention.

FIG. 2 is a typical perspective view for explaining the schematic constitution of the essence of a typical example of an ink jet recording head which is mounted on an ink jet recording apparatus.

Reference numeral 391 represents a ceiling plate having formed thereon a plurality of grooves 393 which become the nozzles through which the ink is passed, a groove 394 which becomes a common liquid chamber communicating to the grooves 393, and a supply port 395 for supplying the ink to said common liquid chamber. 392 is a substrate on which the heating portions 396 of electrothermal converters corresponding to the nozzles and the electrodes 397 for supplying electric power to the heating portions are formed integrally through a film formation technology. By bonding together such ceiling plate 391 and the substrate 392, a plurality of discharge ports (orifices) 398 in communication with the nozzles for discharging the ink are formed.

A recording head 391 with such a constitution is of an ink jet cartridge, integral with, for example, an ink tank for storing the ink supplied through the supply port to the recording head.

<First Example>

FIGS. 3 to 6 show the schematic constitution of a tube pump suction recovery system in a serial ink jet printer which is an ink jet recording apparatus based on a first example of the present invention.

In the figure, reference numeral 10 represents a carriage for mounting a recording head 9, which can be reciprocated in the main scan direction along a guide shaft 11. A head recovery device is mainly comprised of a cap holder 2 having a rubber cap 1 attached thereto, a tube 6 communicating to the cap 1, a stand for supporting the tube 6, and a roll 7, which is rotatably and movably supported through a long hole 2*a*, for stroking the tube 6.

In this example, two convex portions 2*b* are provided on the lateral face of the cap holder 2, each convex portion 2*b* being slidably supported along the main scan direction through a guide hole 4*a* formed on a rib 4 extending upwardly from the bottom portion of a case for recording apparatus main unit. The guide hole 4*a* is a linear opening which is inclined downward around one end thereof. Accordingly, when the convex portion 2*a* is in a downwardly inclined position as shown in FIG. 5, the position of the cap 1 in the space is lowered, whereas when it gets out of that position as shown in FIG. 6, the cap 1 is placed in a position engageable with the discharge port surface of the recording head.

Figure 5:
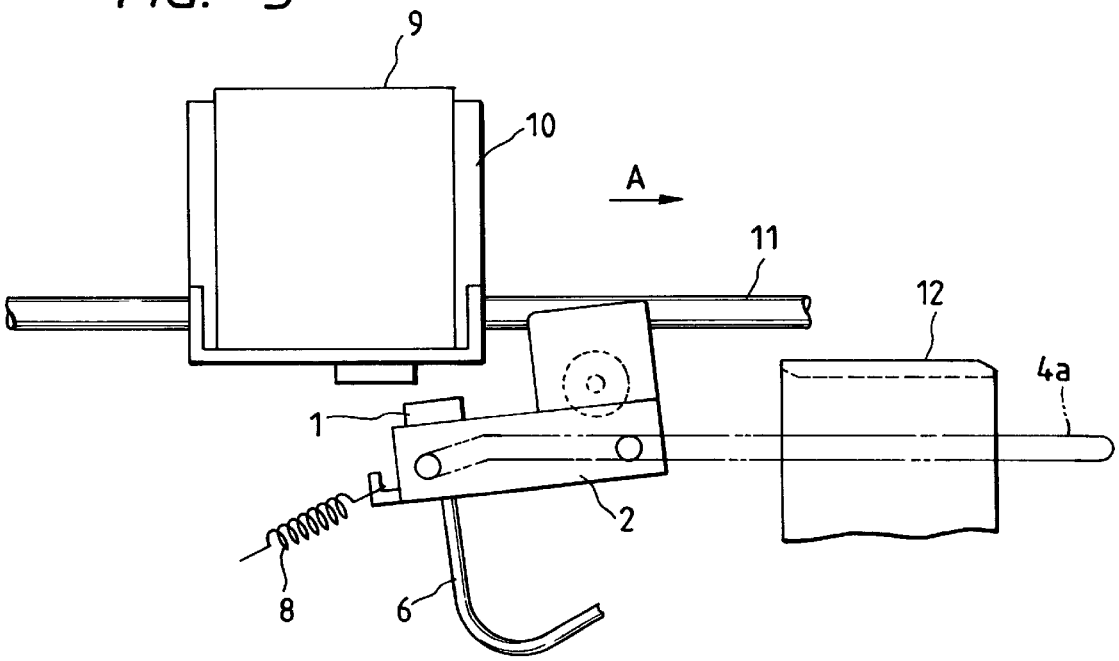
FIG. 5 is a side view for explaining the schematic constitution of the recording head recovery system of the ink jet recording apparatus based on the first example of the present invention, showing the state where a carriage and a cap holder are separated apart.

The cap holder 2 is located at the end of the guide hole 4*a*, biased by a spring 8 (FIG. 5). While the carriage 10 having the recording head 9 mounted is moved along a guide shaft 11 in the main scan direction, a part of the cap holder 2 will engage the carriage 10, both of which are moved integrally in a direction of the arrow A (FIG. 5 and FIG. 6). Accordingly, the cap holder 2 changes its attitude gradually, while moving through the guide hole 4*a*. Thereby, as shown in FIG. 6, the cap 1 can sealingly enclose the nozzle face 9*a* of the recording head 9 to prevent the discharge port surface from drying when the main unit is at rest.

Figure 6:
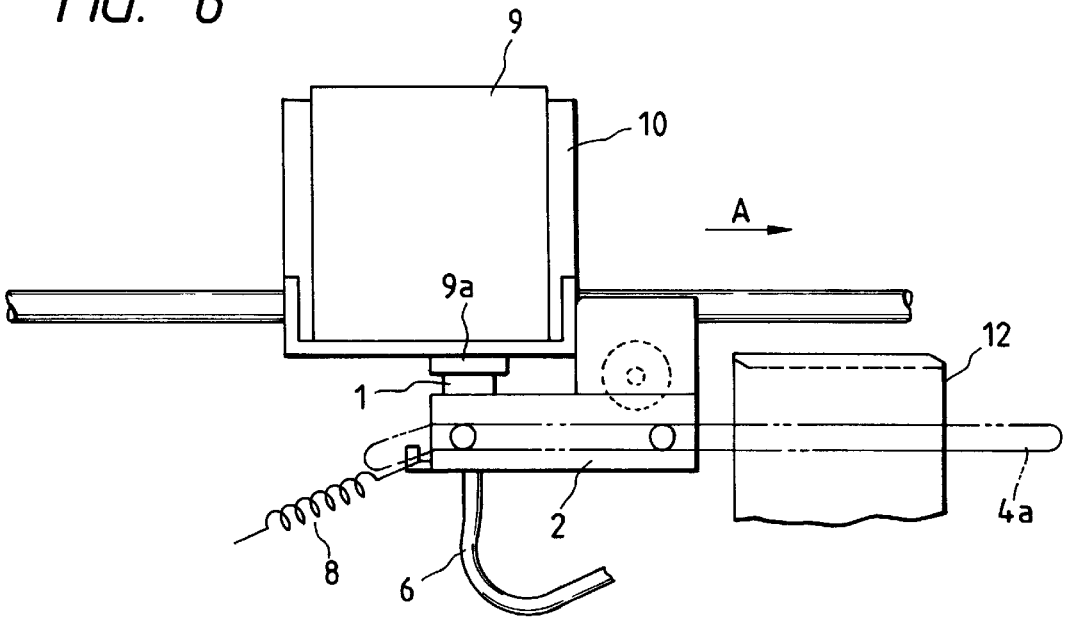
FIG. 6 is a side view for explaining the schematic constitution of the recording head recovery system of the ink jet recording apparatus based on the first example of the present invention, showing the state where the carriage and the cap holder are engaged.
Figure 7:
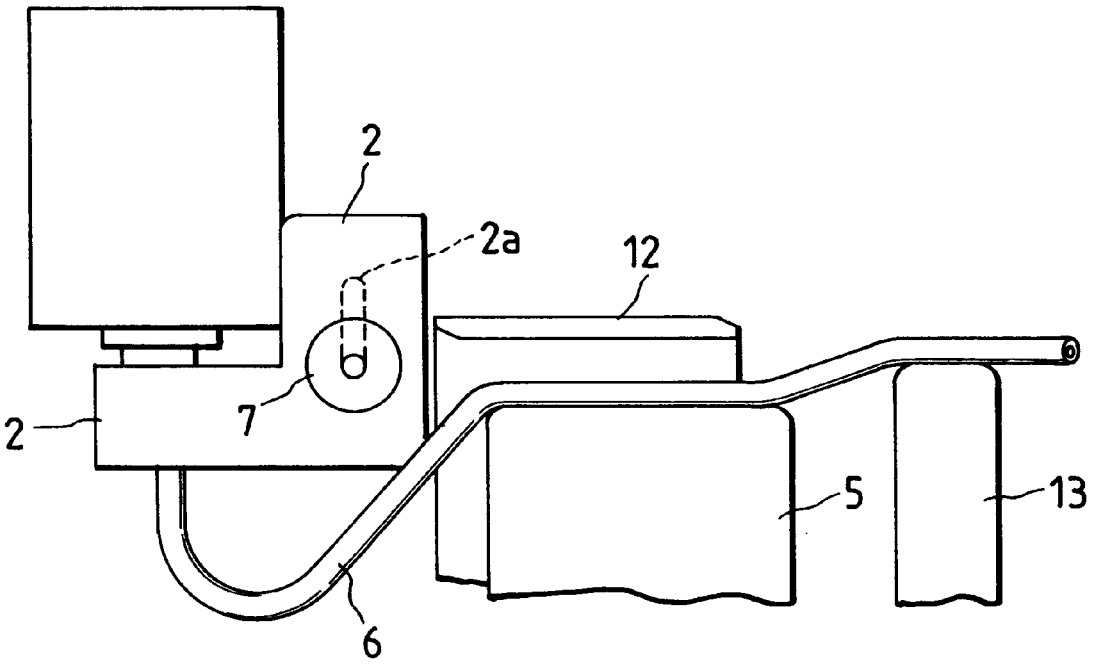
FIG. 7 is a side view for explaining the schematic constitution of the recording head recovery system of the ink jet recording apparatus based on the first example of the present invention, showing the state where the carriage and the cap holder are engaged, and the condition of a suction pump.

FIGS. 7 to 10 are side views showing the tube pump in the actuated state, in which FIG. 7 corresponds to FIG. 6 as above mentioned, that is, the state where the recording head 9 is capped with the cap 1. In this case, the roll 7 does not enter the stroke of squeezing the tube 6, wherein the tube remains open. Therefore, no ink within the discharge ports is passed back owing to a negative pressure generated upon capping with the cap 1.

Figure 8:
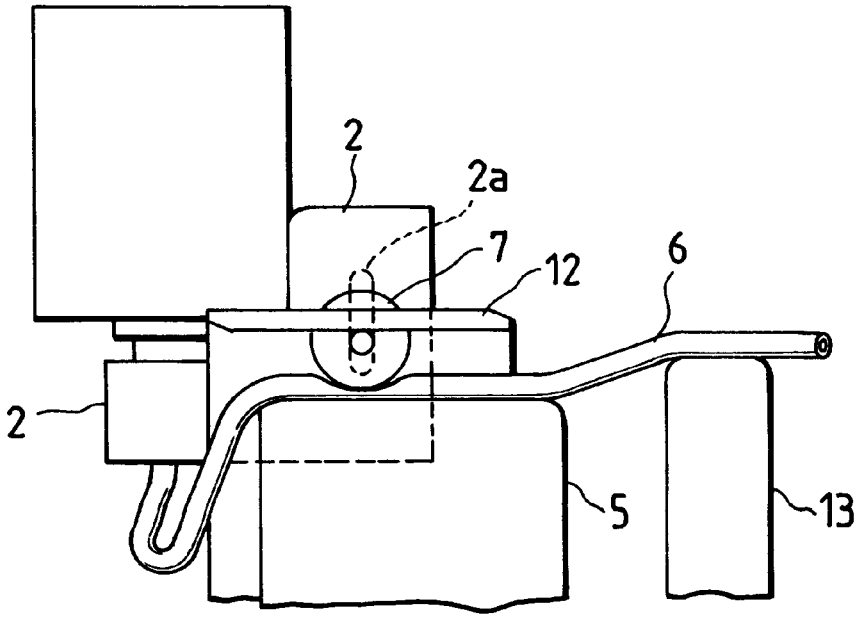
FIG. 8 is a side view for explaining the schematic constitution of the recording head recovery system of the ink jet recording apparatus based on the first example of the present invention, showing the state where the carriage and the cap holder are engaged, and the condition of the suction pump.

Further, if the cap holder 2 is moved, the roll 7 is rolled while squeezing the tube 6 against the stand 5, restricted by the lower surface of a guide 12 as shown in FIG. 8. Thereby, a negative pressure occurs within the cap 1 and the tube 6, thereby sucking the ink from the ink jet head 9 to recover the discharge ports from clogging. At this time, if the amount of squeezing the tube 6 varies, a leak may occur, or the load for moving the cap holder 2 may be remarkably increased. With this constitution, because the guide 12 and the stand 5 are formed integrally with the lower case 3, the relative positional dimension of both which may have significant effect on the amount of squeezing the tube 6 can be managed with high precision. Accordingly, the good pumping operation can be accomplished.

Figure 9:
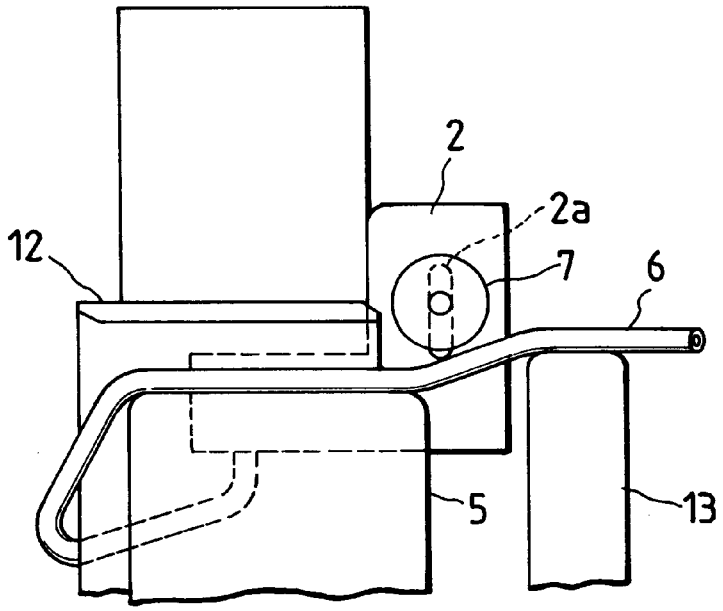
FIG. 9 is a side view for explaining the schematic constitution of the recording head recovery system of the ink jet recording apparatus based on the first example of the present invention, showing the state where the carriage and the cap holder are engaged, and the condition of the suction pump.
Figure 10:
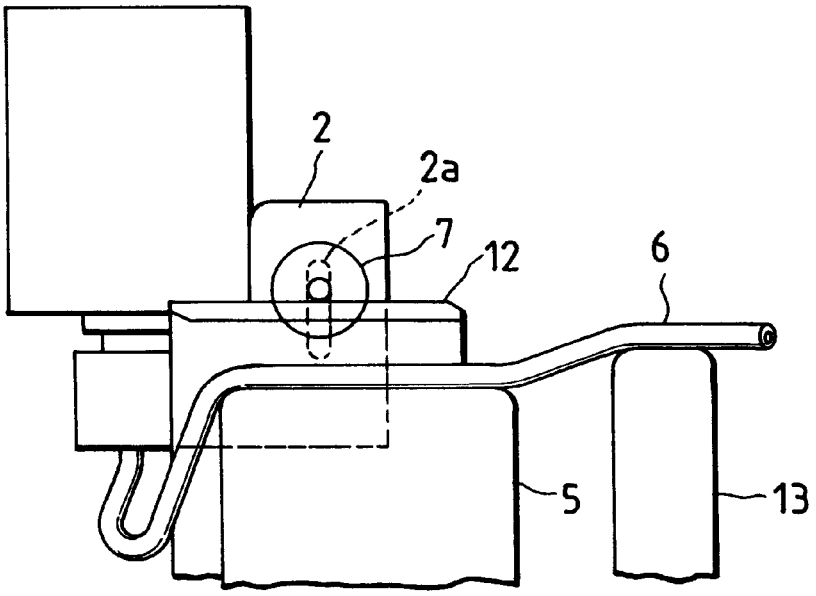
FIG. 10 is a side view for explaining the schematic constitution of the recording head recovery system of the ink jet recording apparatus based on the first example of the present invention, showing the state where the carriage and the cap holder are engaged, and the condition of the suction pump.

FIG. 9 is a side view showing the state where the pumping run is terminated, wherein the roll 7 gets out of the guide 12 so that the tube 6 is opened. The tube 6 is lifted up by a pedestal 13 which is at a higher position than the stand 5, thereby causing the roll 7 to be displaced through the long hole 2*a*. If the carriage 10 is moved back from this position, the cap holder 2 is returned by the spring 8. In this case, however, the roll 7 rolls over the upper surface of the guide 12 and does not press the tube 6 as shown in FIG. 10, no ink within the tube 6 is flowed back in a direction toward the cap 1. If the roll 7 gets out of the guide 12, it falls down on the lowermost end of the long hole 2*a* with the dead weight of the roll 7, returning to the state of FIG. 7.

Note that the top end of the tube 6 is connected to a waste ink chamber, not shown, into which the sucked ink is transferred.

<Second Example>

Figure 11:
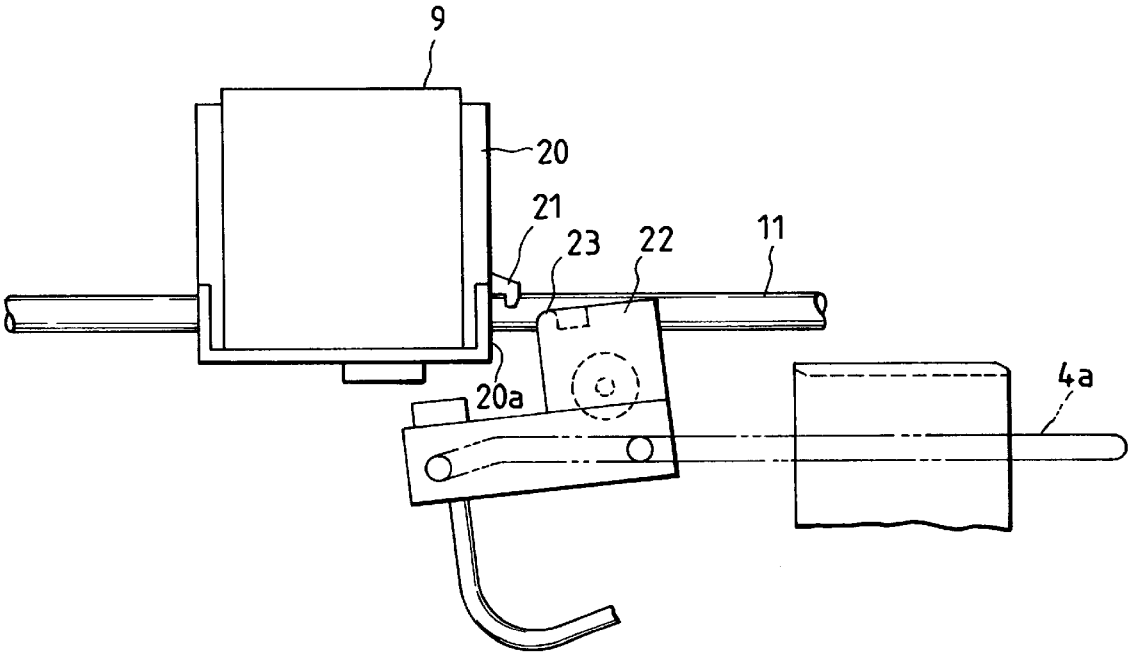
FIG. 11 is a side view for explaining the schematic constitution of a recording head recovery system of an ink jet recording apparatus based on a second example of the present invention, showing the state where a carriage and a cap holder are separated apart.
Figure 12:
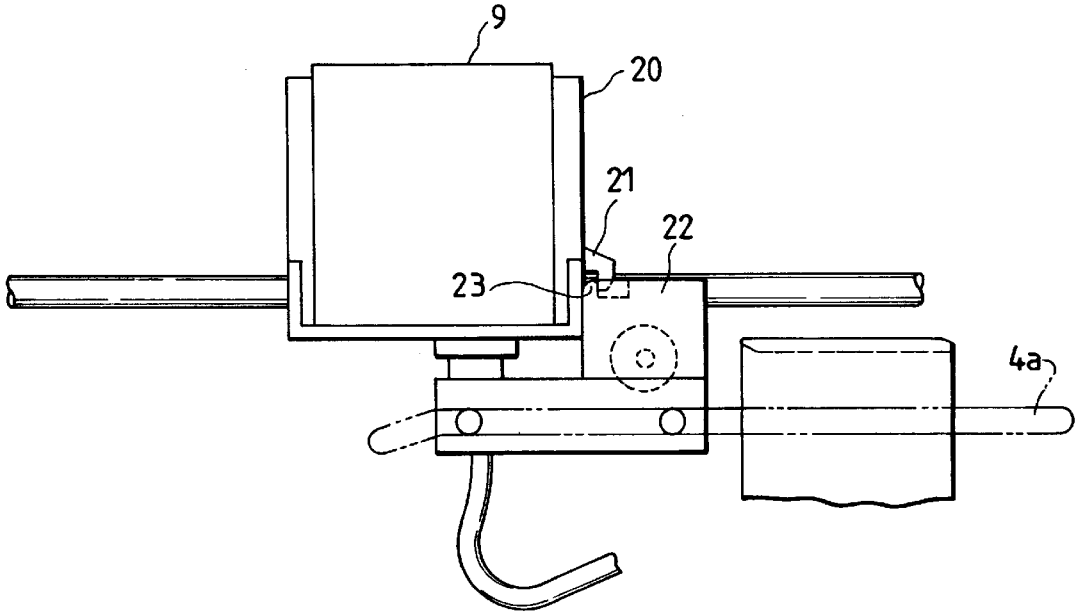
FIG. 12 is a side view for explaining the schematic constitution of the recording head recovery system of the ink jet recording apparatus based on the second example of the present invention, showing the state where the carriage and the cap holder are engaged.

FIGS. 11 and 12 are side views for explaining a second example of the present invention. Herein, this second example is described with specific features only, by omitting the description about the same parts as in the first example. A carriage 20 is provided with an engaging claw 21 and a cap holder 22 is provided with an engagement portion 23. That is, the cap holder 22 is not biased by a spring. Namely, the movement of the cap holder 22 in both the pump run and the return run are effected by the movement of the carriage 20.

In an initial state, the cap holder 22 is inclined, with the engagement portion 23 at lower position, as shown in FIG. 11, so that the engaging claw 21 of the carriage 20 passes over the cap holder 22 and presses the cap holder 22 outwards with a wall face 20*a*.

In the return run, the engaging claw 21 engages the engagement portion 23, as shown in FIG. 12, to return the cap holder 22 together with the carriage 20, so that the cap holder can get out of engagement immediately before the cap holder 22 returns to the initial state. According to this, the spring can be dispensed with, so that the cost is reduced, and no load with a biasing force of the spring in the pump run is necessary, whereby the load of a carriage driving motor, not shown, can be reduced.

<Third Example>

Figure 13:
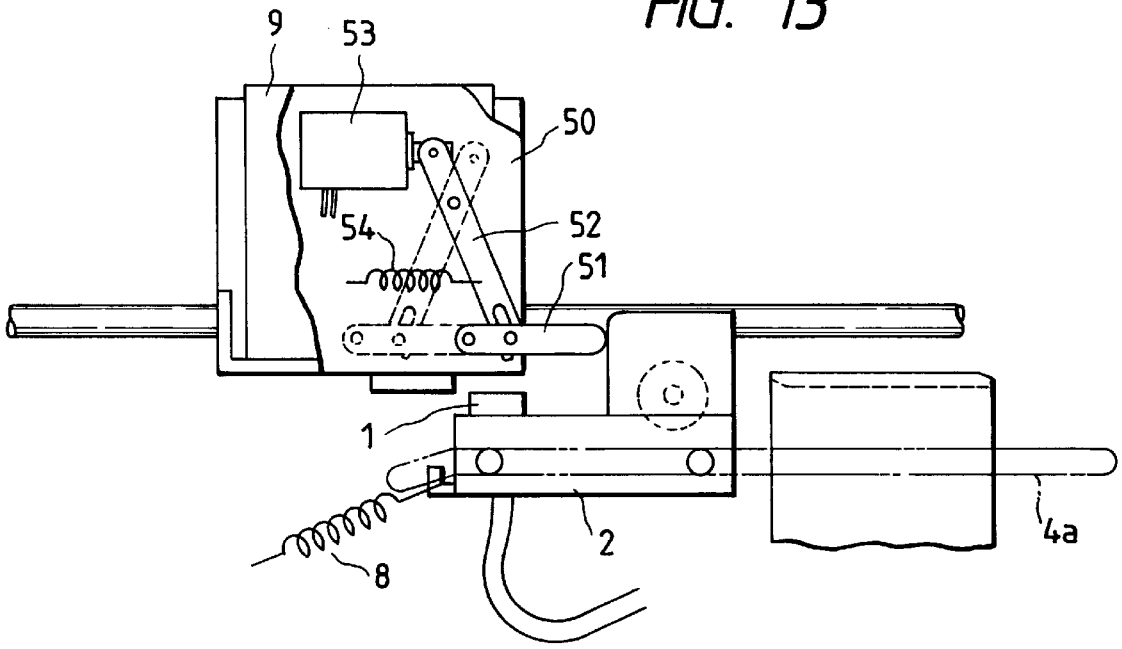
FIG. 13 is a side view for explaining the schematic constitution of a recording head recovery system of an ink jet recording apparatus based on a third example of the present invention.

FIG. 13 is a side view for explaining a third example which is a variation of the second example as above described, wherein an engaging member 51 of a carriage 50 is slidably provided, and connected via a lever 52 to a solenoid 53. Herein, the lever 52 is biased by a spring 54, and the engaging member 51 is normally accommodated within the carriage 50 (as shown by the dotted line), whereby the enclosing of an ink jet head 9 with a cap 1 and the pumping operation are similarly performed as previously described.

Herein, if the solenoid 53 is energized, the lever 53 is turned, so that the engaging member 51 projects out of the carriage 50. In this state, if the carriage 50 is moved, the engaging member 51 engages the cap holder 2, whereby the pumping operation is effected while the ink jet head 9 remains open. According to this, the ink sucked within the cap 1 and the tube 6 can be passed further downward, so that the ink tank possibly accumulating within the cap 1 can be resolved.

<Fourth Example>

Figure 14:
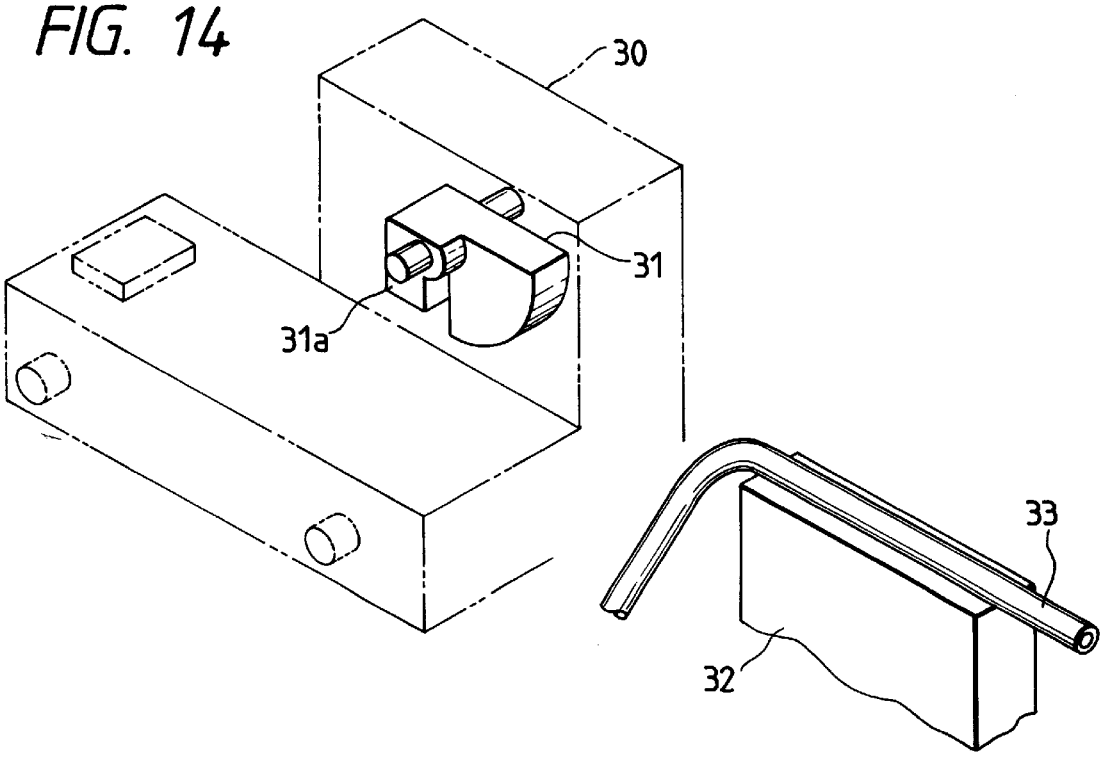
FIG. 14 is a perspective view for explaining the schematic constitution of a recording head recovery system of an ink jet recording apparatus based on a fourth example of the present invention.

FIG. 14 is a perspective view for explaining a further example. A cap holder 30 rotatably supports a deformed roll 31 with an arcuate section extending over roughly one-quarter of the circumference. The deformed roll 31 has a weight portion 31*a*, and is set to take an attitude as shown in the natural state. And if a cap holder 30 is moved in interlock with a carriage, not shown, the deformed roll 31 squeezes a tube 33 set on a stand 32 while rotating. FIGS.

Figure 15:
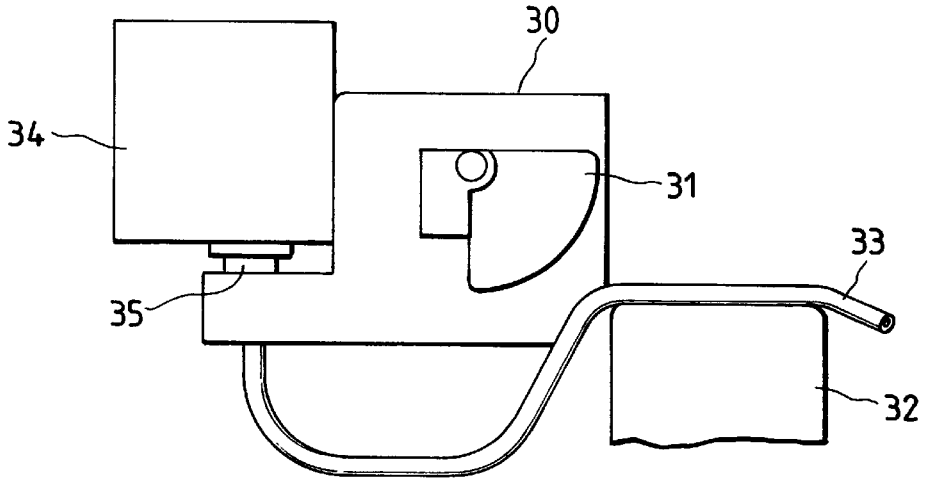
FIG. 15 is a side view for explaining the schematic constitution of the recording head recovery system of the ink jet recording apparatus based on the fourth example of the present invention, showing the state where a carriage and a cap holder are engaged, and the condition of a suction pump.

15 and 17 are cross-sectional views showing the operation states of a tube pump. In FIG. 15, an ink jet head 34 is capped with a cap 35, and the deformed roll 31 is in the initial attitude.

Figure 16:
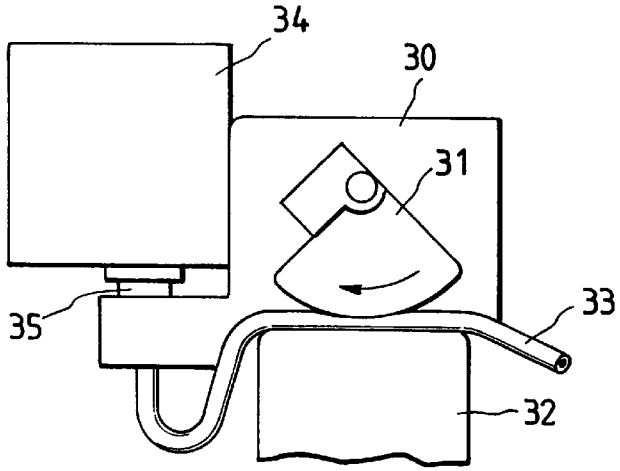
FIG. 16 is a side view for explaining the schematic constitution of the recording head recovery system of the ink jet recording apparatus based on the fourth example of the present invention, showing the state where the carriage and the cap holder are engaged, and the condition of the suction pump.
Figure 17:
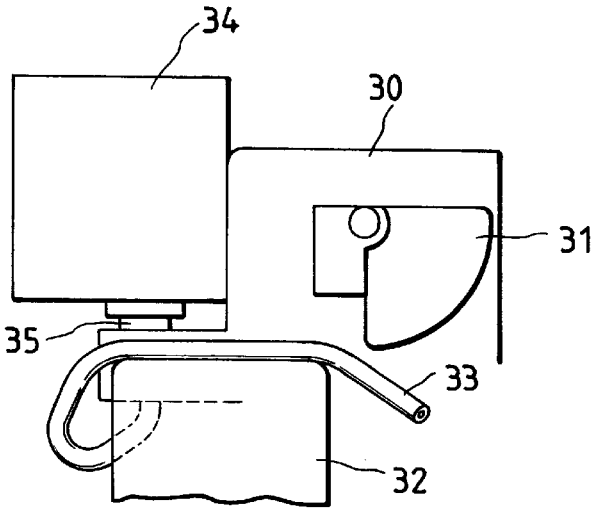
FIG. 17 is a side view for explaining the schematic constitution of the recording head recovery system of the ink jet recording apparatus based on the fourth example of the present invention, showing the state where the carriage and the cap holder are engaged, and the condition of the suction pump.

If the cap holder 30 is moved to begin squeezing the tube 33, the deformed roll 31 is rotated as shown in FIG. 16, and is restored to the initial attitude again, when it goes out of the stand 32, as shown in FIG. 17.

Figure 18:
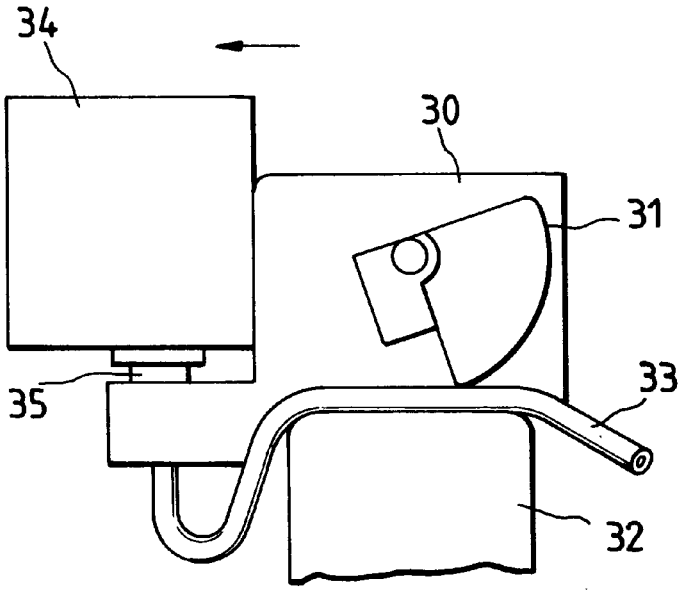
FIG. 18 is a side view for explaining the schematic constitution of the recording head recovery system of the ink jet recording apparatus based on the fourth example of the present invention, showing the state where the carriage and the cap holder are engaged, and the condition of the suction pump.

The return run is entered from here, wherein the deformed roll 31 is rotated in reverse direction to escape therefrom, as shown in FIG. 18, so that no ink within the tube 33 is flowed back toward the cap 35.

This can achieve the same effects as in the previous example.

<Fifth Example>

Figure 19:
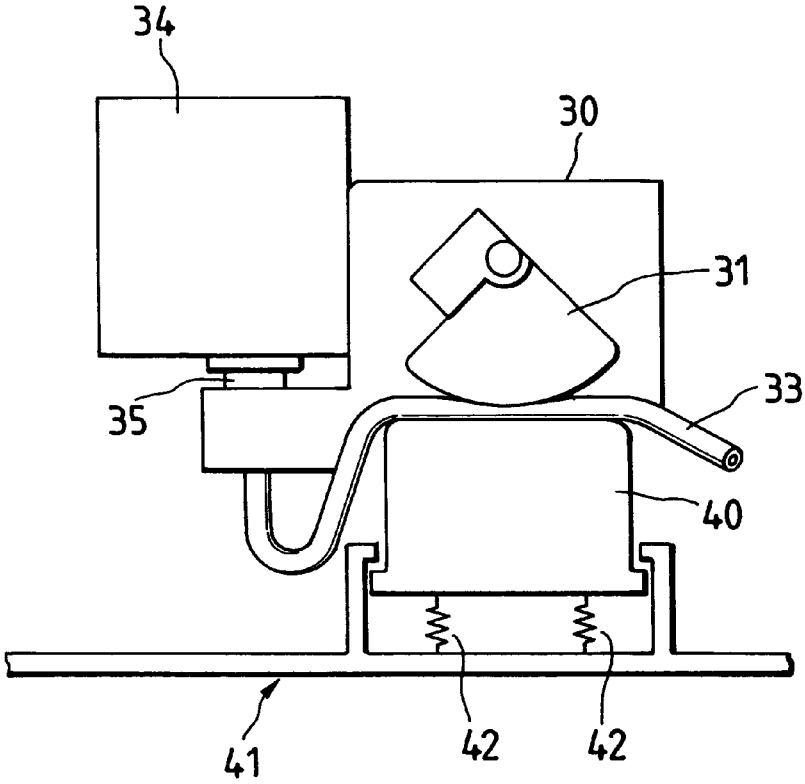
FIG. 19 is a side view for explaining the schematic constitution of a recording head recovery system of an ink jet recording apparatus based on a fifth example of the present invention, showing the state where a carriage and a cap holder are engaged, and the condition of a suction pump.

FIG. 19 is a side view for explaining a still further example. A stand 40 is provided displaceably via a spring 42 on a lower case 41.

Namely, a tube 33 is squeezed by a biasing force of a spring 42. In this example, the increased number of components is necessary so that the cost is raised, as compared to the previous example, but because of stable squeezing pressure of the tube 33, the variation in the load in moving the cap holder 30 can be effectively suppressed.

As above described, the ink jet recording apparatus in the above example has the cap holder interlocked with the carriage, wherein the tube is stroked with a roll held on the cap holder. Thereby, it is possible to provide a very simple and inexpensive recovery means.

Also, since the tube pump is controlled with the positional control of the carriage, a fixed suction recovery state can be always reproduced without having to provide any special sensing means.

Further, since the tube is automatically opened upon termination of the pump run, and the tube is not stroked in the return run, the ink can be prevented from flowing back without adding any extra components.

<Sixth Example>

Figure 20:
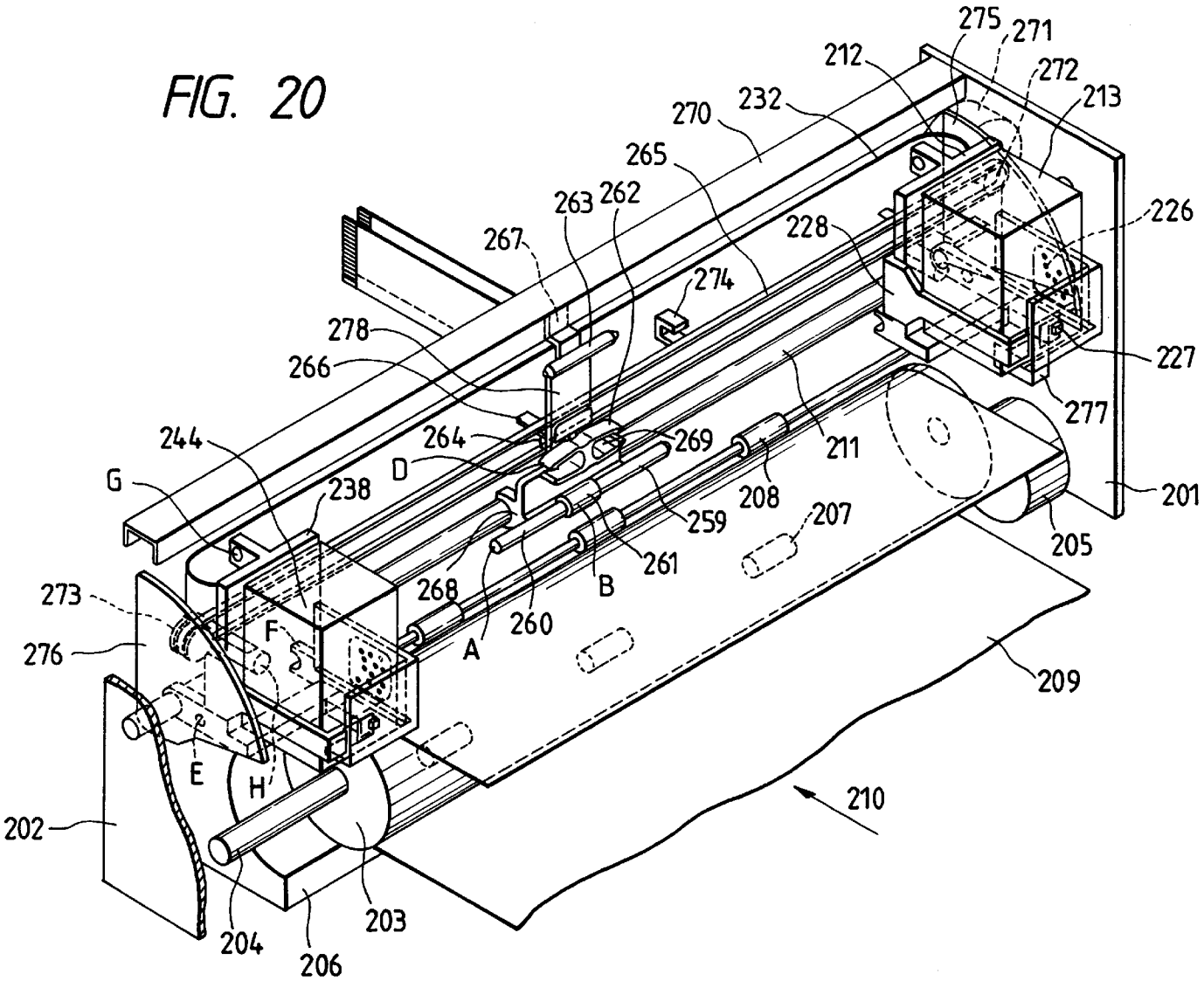
FIG. 20 is a perspective view showing the essence of an ink jet recording apparatus based on a sixth example of the present invention.

A sixth example of the present invention will be described below with reference to FIGS. 20 to 29. This example is an application example to an ink jet recording apparatus. FIG. 20 is a perspective view showing the essence of the ink jet recording apparatus according to this example.

201 is a right side plate and 202 is a left side plate. 203 is a platen roller made of an elastic material. 204 is a platen roller shaft formed around the center of the platen roller, the left and right ends being supported by the left side plate 202 and the right side plate 203, respectively 205 is a paper feeding motor, which is supported by the right side plate 201 to rotate the platen roller shaft 204 via a gear train, not shown. 206 is a paper guide provided along the periphery of the platen roller 203. 207 and 208 are pinch rollers, which are pressed down against the surface of the platen roller 203 at a predetermined pressure by a spring, not shown. A recording sheet 209 as the conveyed medium is supplied from a direction of the arrow 210, inserted from between the platen roller shaft 204 and a paper guide 206, carried between the pinch rollers 207, 208 and the platen roller shaft 204, and conveyed in the U-character bent form. 211 is a guide shaft having a diameter of 10 mm as a guide mechanism, its ends being supported by the left and right side plates 201, 202.

Figure 21:
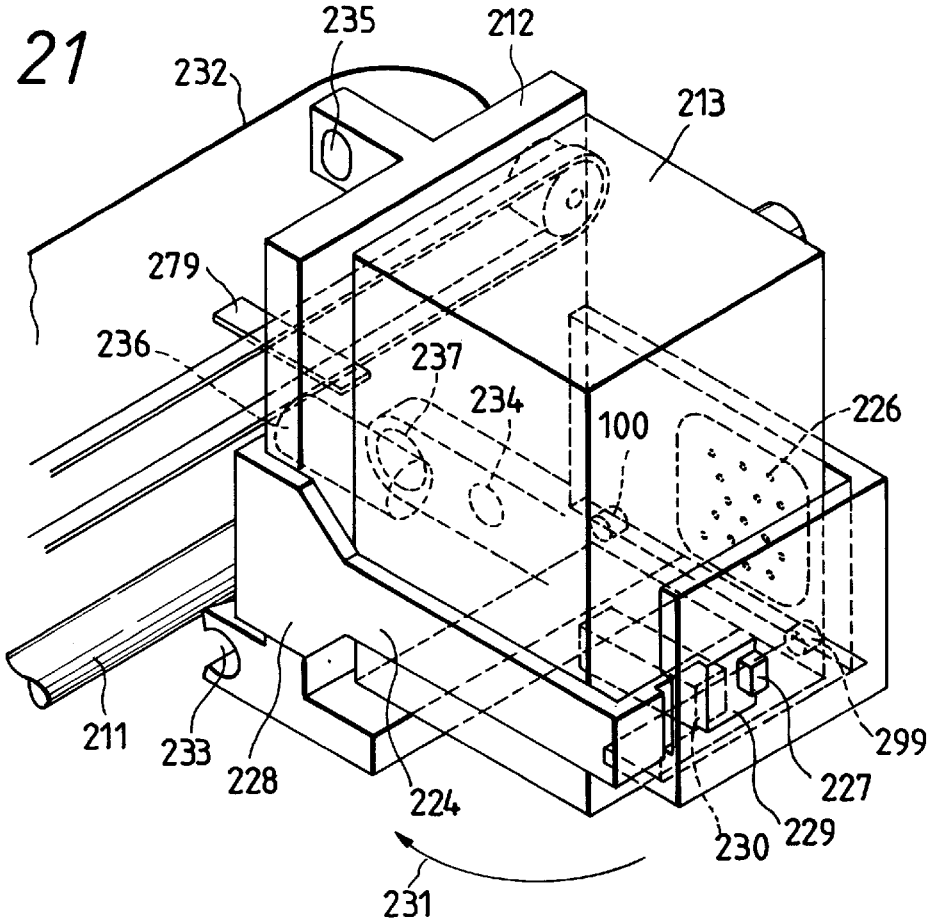
FIG. 21 is a perspective view showing a carriage for black ink as shown in FIG. 20.
Figure 22:
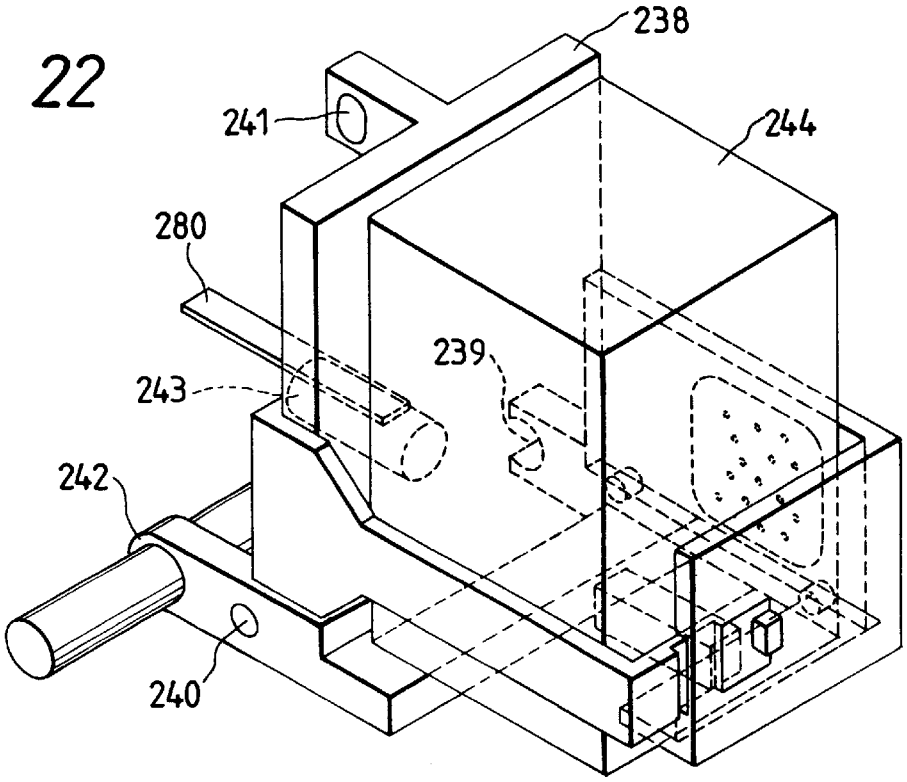
FIG. 22 is a perspective view showing a carriage for color ink as shown in FIG. 20.

212 is a carriage for black ink as a functional element mounting carriage. Referring to FIG. 21, the details for the carriage for black ink 212 will be described. This carriage for black ink 212 has a black ink cartridge 213 mounted thereon. 224 is a cartridge hook which serves to press the cartridge 213 onto a contact portion 226 located within the carriage 212. Upon pressing a button 227, an engaging portion 230 gets out of a square hole 229 provided on the carriage 212, so that the hook 224 is rotated around a fulcrum 228 in a direction indicated by 231. With this hook 224 left opened, the black ink cartridge 213 is inserted into the carriage 212 from upward, and upon closing the hook 224, the cartridge 213 is pressed against the contact portion 226 and secured thereto. The pins 299, 100 project out of the carriage 212, these pins being fitted into the tooling holes of an aluminum plate as will be described later which are annexed to the cartridge 213. The cartridge 213 is positioned against the base of the pins 299, 100. 232 is a flexible cable, which is flexed in accordance with or following the movement of the carriage 212. The flexible cable 232 is disposed within the carriage 212 with the contact portion 226 formed at the end portion, thereby giving an ink discharge signal as the functional element driving signal from the substrate, not shown, to the cartridge 213. The carriage 212 has fitting holes 233, 234, 235 for the integration with a scanner 278 as the carrier described below, and a grip portion 236. The hole 235 is a long hole extending vertically, and the grip portion 236 extends outwards from a wall portion of the carriage 212. Also, 237 is a hole provided on the carriage 212 through which the guide shaft 211 extends, with the inner diameter being set to 10.2 mm to produce no frictional load upon integration with the scanner 278. By fitting the guide shaft 211 into the hole 237, the carriage 212 is swingably engaged by the guide shaft 211 as the guide mechanism, and held with the lower swinging motion restricted at a position on the cap 277 (see FIG. 20) as hereinafter described as a first standby position. 279 is a sensor shielding plate for black carriage for shielding a light transmission type home position sensor 274 as will be described later.

In FIG. 20, 238 is a carrier for color ink, on which a color ink cartridge 244 is mounted. This carriage 238 will be described below with reference to FIG. 22. The carriage 238 has a similar shape to that of the carriage for black ink 212 as shown in FIG. 21, and is only different in that 239, 240 and 241 are fitting holes with the scanner 278, and the fitting holes 239, 240 are inversely disposed in the lateral position to those of fitting holes 233, 234 for the carriage for black ink 212. The hole 41 is a long hole extending vertically. 243 is a grip portion which projects outwards from a wall portion of the carriage 238. 280 is a sensor shielding plate for color carriage. Also, the carriage 238 is provided with a hole 242 similar to the hole 237 of the carriage 212, and by fitting the guide shaft 211 into this hole 242, the carriage 212 is swingably engaged in the guide shaft 211 as the guide mechanism. Also, a cap, like the cap 277, disposed at a position opposed to the carriage 238 in FIG. 20, has a first standby position on its upper surface, for restricting the swinging motion of the carriage 238 downward and holding it.

The black ink cartridge 213 has an ink tank for receiving the black ink and an ink jet recording head as the functional element to discharge the black ink. The ink tank has internally a sponge, not shown, for containing the ink. The capacity of ink amounts to, for example, 100 sheets of recording paper 209 of A4 size in the text printing. Also, a radiating aluminum plate, not shown, provided in the cartridge 213, has a tooling hole for the carriage 212. Further, a substrate having a contact point, not shown, corresponding to the contact portion 226 is secured in parallel to this aluminum plate.

The color ink cartridge 244 has a black ink tank, a color ink tank, and a color ink jet recording head as the functional element, wherein the respective ink tanks are different from the ink tank 213 for the black ink cartridge as previously described, and can be replaced by detaching them from the color recording head. The ink tank has an internal sponge structure, like that of the black ink cartridge 213. Within the color tank is formed the ink receiving areas for yellow, magenta and cyan inks, so that respective inks are supplied from the sponge accommodated within such areas via an ink supply port to the ink jet recording head.

Referring now to FIG. 20, the scanner 278 as a scan-type carrier will be described. In FIG. 20, bearings 268, 269 to the left and right of the scanner 278 are fitted into the guide shaft 211. Also, an upper guide 267 can slide along a rail 270. 265 is a belt, which is secured to a belt stopper 264 as the receiving portion of driving force located intermediately in the left and right directions of the scanner 278. The belt 265 is hung at one side around a motor pulley 272, the other side being hung around a tension pulley 273 biased toward a direction of stretching the belt owing to a spring, not shown. By driving the carrier motor 271, the scanner 278 is moved in the main scan direction. 266 is a sensor shielding plate for producing an output signal for the positional control of the scanner 278 by shielding the optical path of the light transmission type home position sensor 274.

Figure 26:
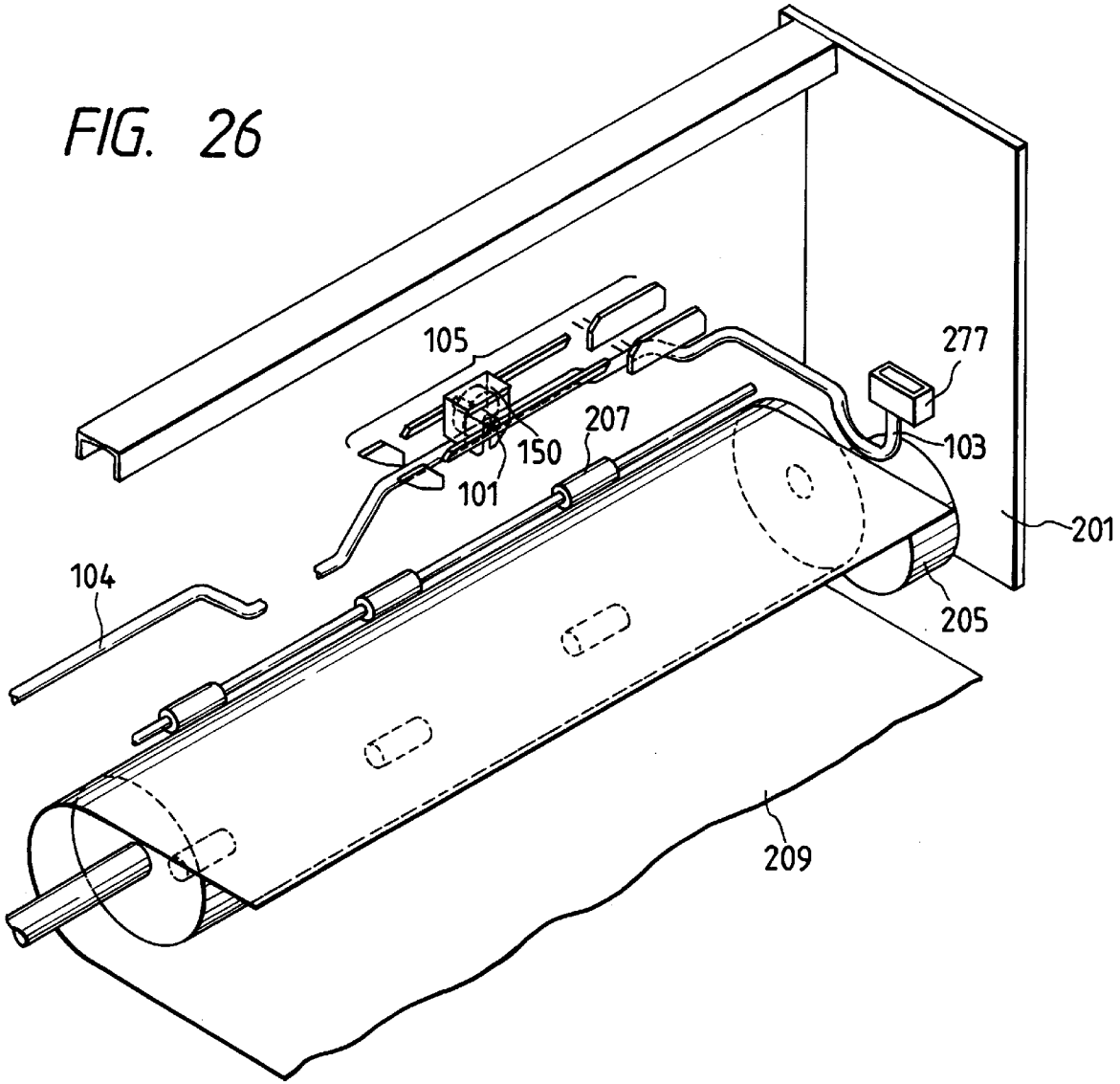
FIG. 26 is a perspective view of the essence for explaining how to dispose a tube connecting to a cap as shown in FIG. 20.
Figure 27:
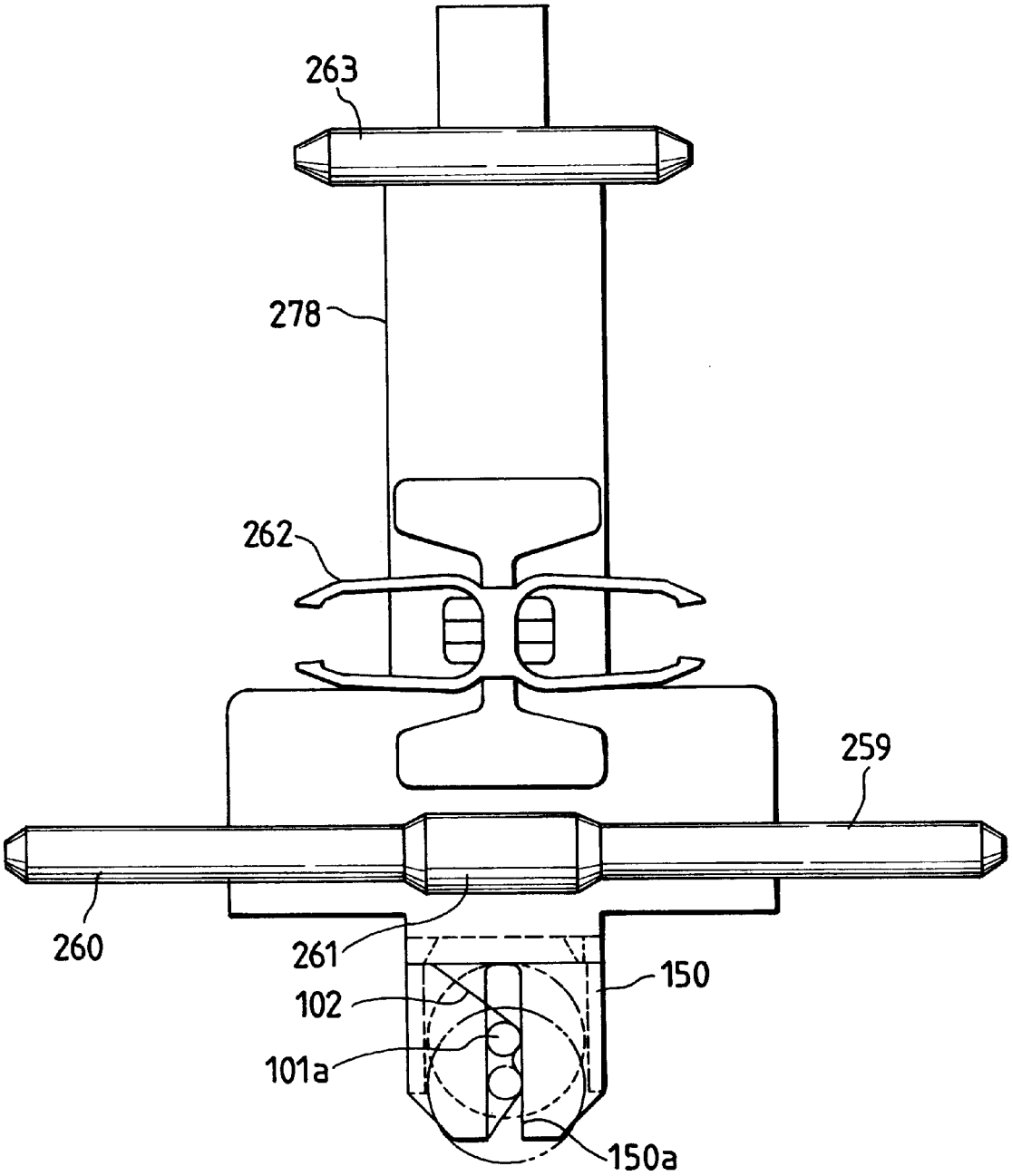
FIG. 27 is a front view of the essence for explaining the disposition state of a roll as shown in FIG. 26.

In FIG. 26, 101 is a roll as the pressing portion which is held movably in up and down directions in the figure in a rear extension 150 of the scanner 278. 105 is a cam formed of a member secured to the printer to restrict the vertical position of the roll 101. Referring to FIG. 27, the roll 101 will be described below. The rear extension 150 of the scanner 278 is formed with a slit 150*a* extending vertically, the slit 150*a* being engaged by a shaft 101*a* of the roll 101 (hereinafter referred to as a "roll shaft"). 102 is a leaf spring secured to the rear extension 150 of the scanner 278, for biasing the roll shaft 101*a* to the left in the figure. The leaf spring 102 has two bends as shown to hold the roll 101 stably between a first position indicated by the solid line and a second position indicated by the two-dot chain line.

Figure 25:
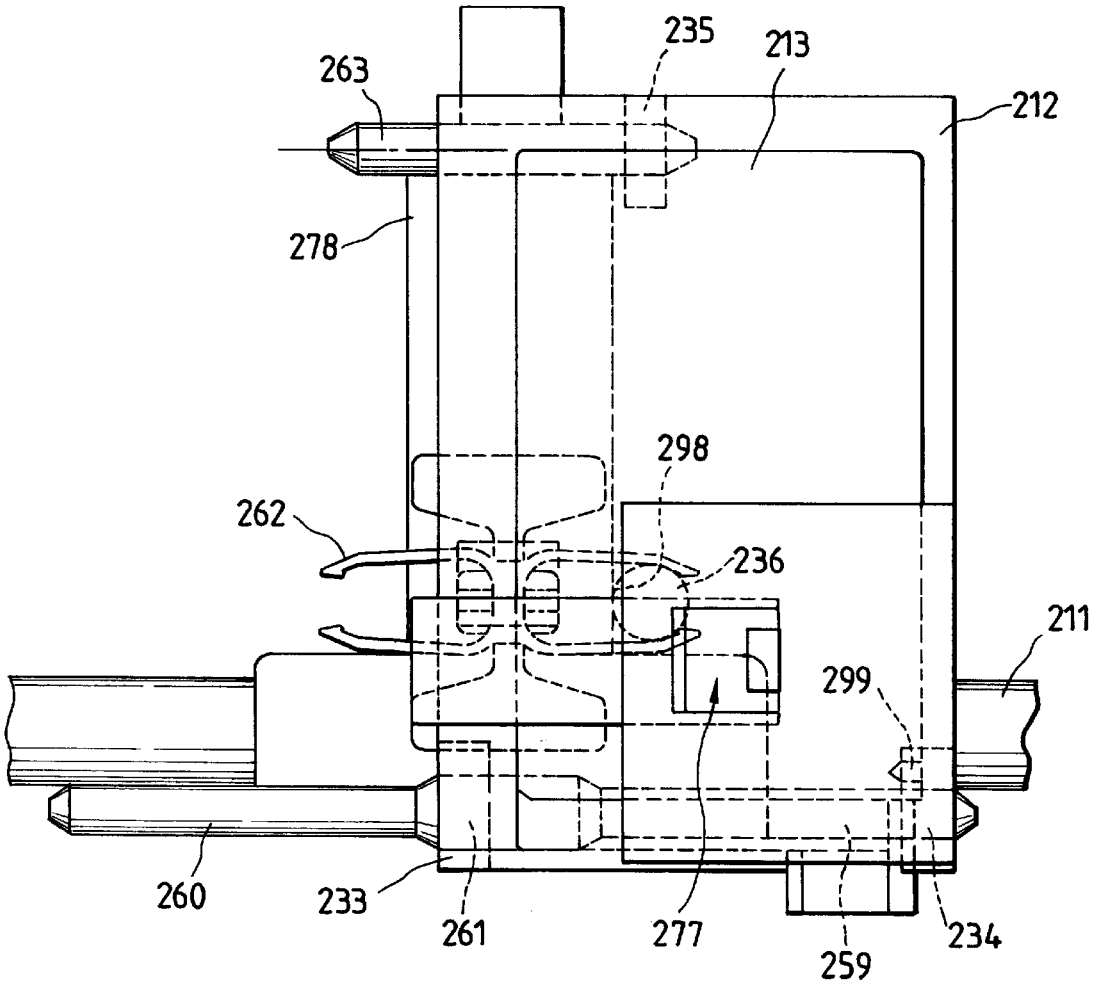
FIG. 25 is a front view showing the coupled state between the carriage for black ink and the carrier as shown in FIG. 20.

262 is a resin gripper, secured onto the scanner 278, for gripping the grip portions 236, 243 disposed on the black ink carriage 212 and the color ink carriage 238, respectively, by means of a forked claw. FIG. 25 is a front view showing the state where the scanner 278 and the black ink carriage 212 are connected. The grip portion 236 of the carriage 212 abuts against a stopper portion 298 of the scanner 278, and is held therein. Namely, the cartridge 213 is positioned with respect to the carriage 212 against the base of the tooling pins 299, 100, and the carriage 212 is positioned against the stopper portion 298 with respect to the scanner 278. Thereby, upon scanning of the scanner 278, the recording can occur at the correct position of the paper 209. In the state where the scanner 278 grips the grip portion 236 of the black ink carriage 212, the fitting shafts 259, 261, 263 of the scanner 278 are fitted into respective fitting holes 234, 233, 235 of the carriage 212, so that the scanner 278 and the carriage 212 can be scanned as a piece. On the other hand, when the color ink carriage 238 and the scanner 278 are put together, the gripper 262 grips the grip portion 236, and the fitting shafts 260, 261, 263 of the scanner 278 are fitted into respective fitting holes of the color ink carriage 238, so that they can be scanned as well. The gripper 262 and the fitting shafts 259, 261, 263 form an engagement mechanism for restricting the swinging motion of the carriages 212, 238, when the carriage 212, 238 located on the cap as the first or second standby site is coupled with the scanner 278 and mounted thereon.

275 is a resin black gripper for restraining the black ink carriage 212 at a position as shown in FIG. 20, and 276 is a color gripper for restraining the color ink carriage 238 at a position as shown in FIG. 20 as well. The black gripper 275 and the color gripper 276 are in the mirror image relationship in the shape, with their operations being identical, and therefore the black gripper 275 is only described.

Figure 23A:
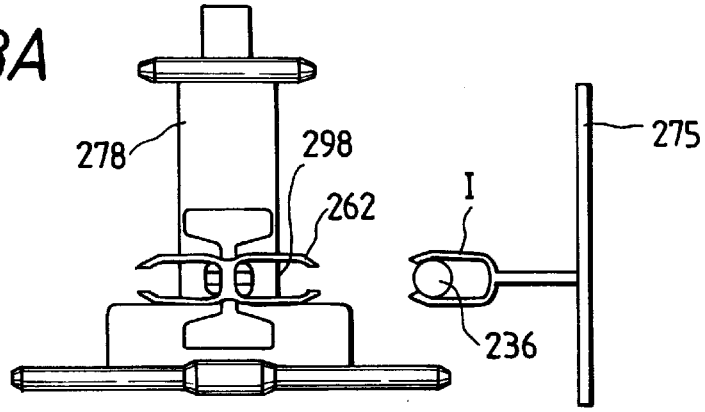
FIGS. 23A to 23D are front views of the essence for explaining the coupling operation between the carriage for black ink and the carrier as shown in FIG. 20.
Figure 23B:
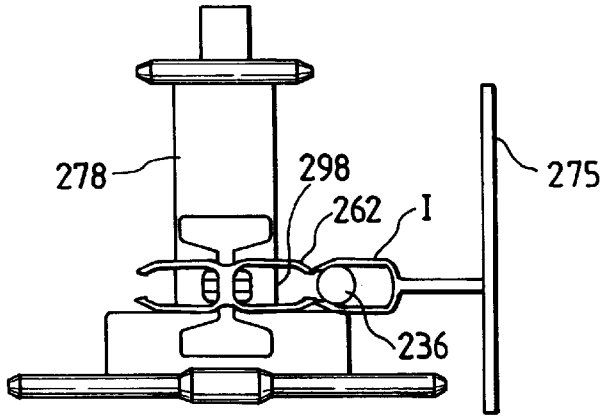
Figure 23C:
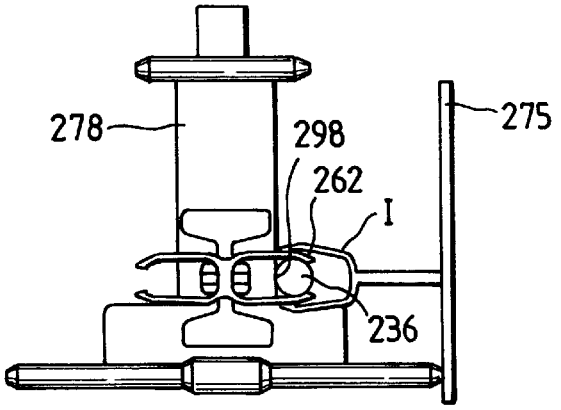
Figure 23D:
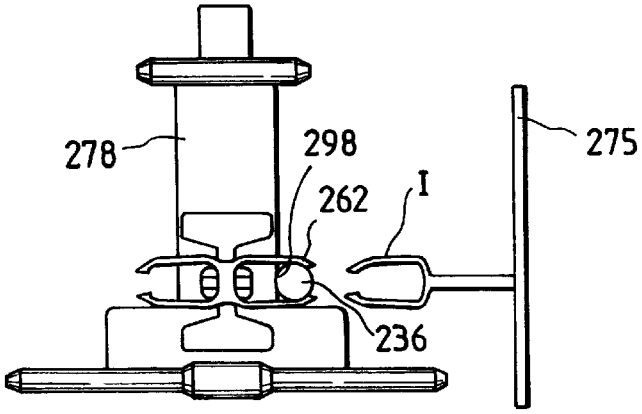
Figures 24, 24A:
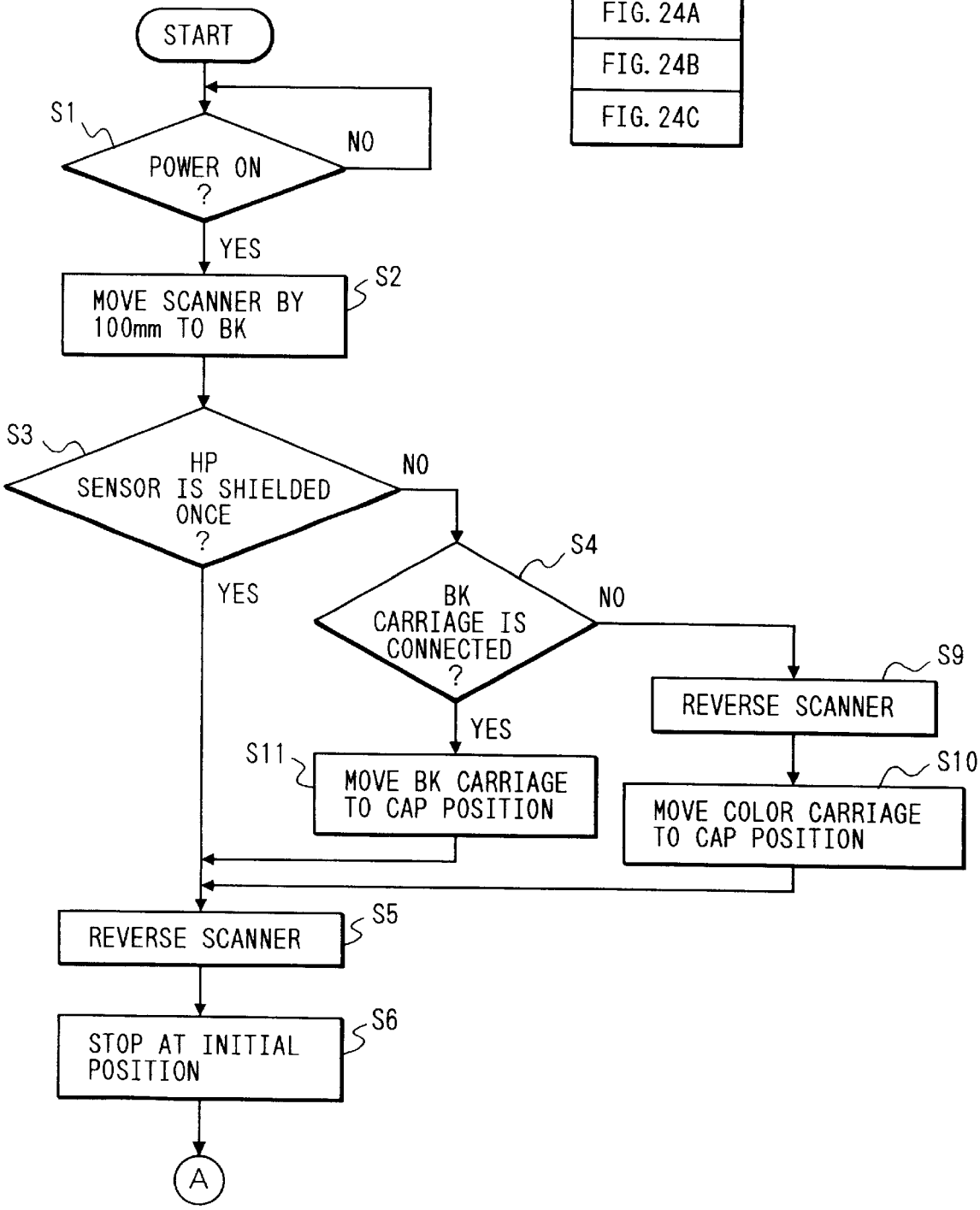
FIG. 24 is comprised of FIGS. 24A to 24C showing flowcharts for explaining the operation of the sixth example of the present invention.
Figure 24B:
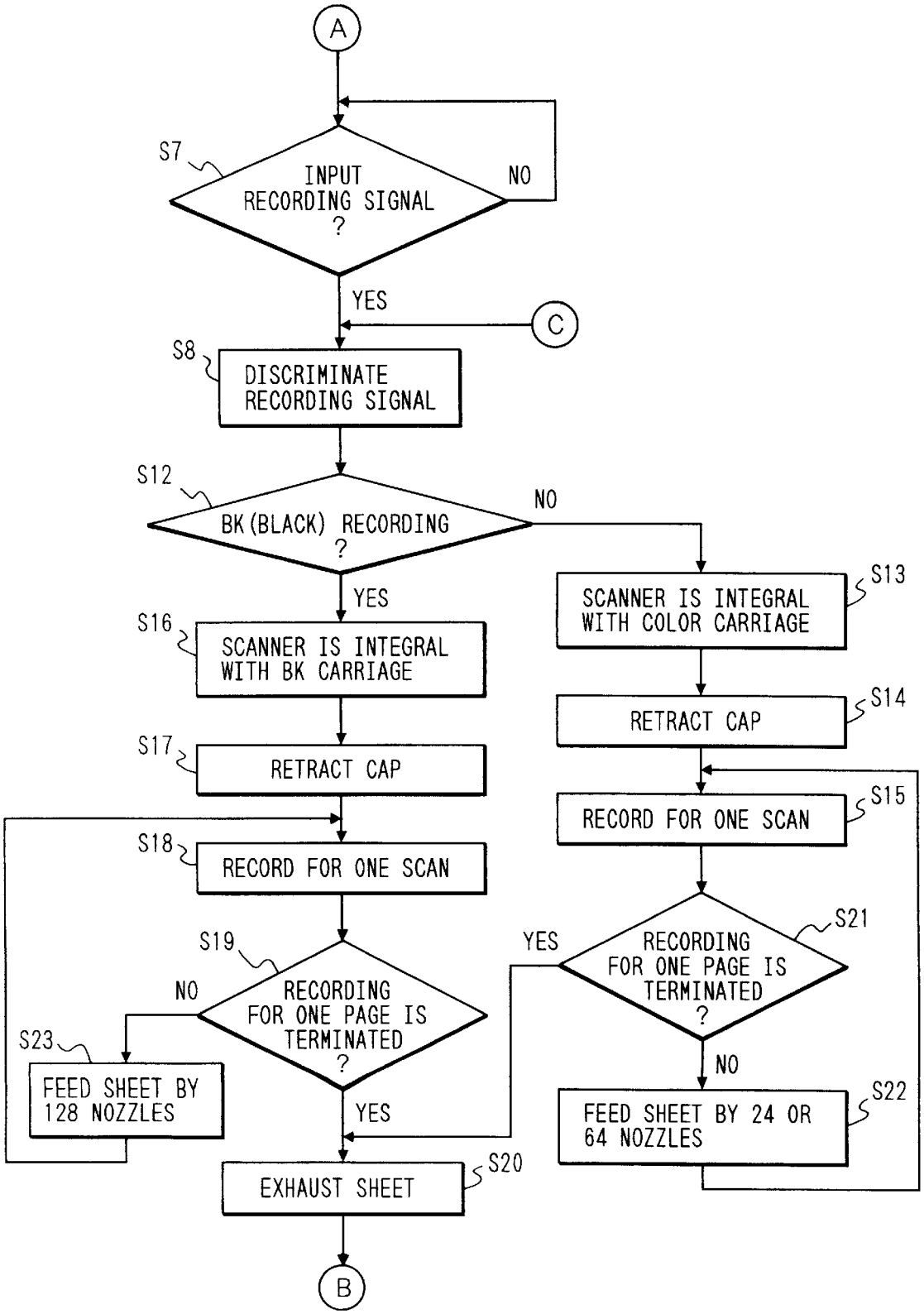
Figure 24C:
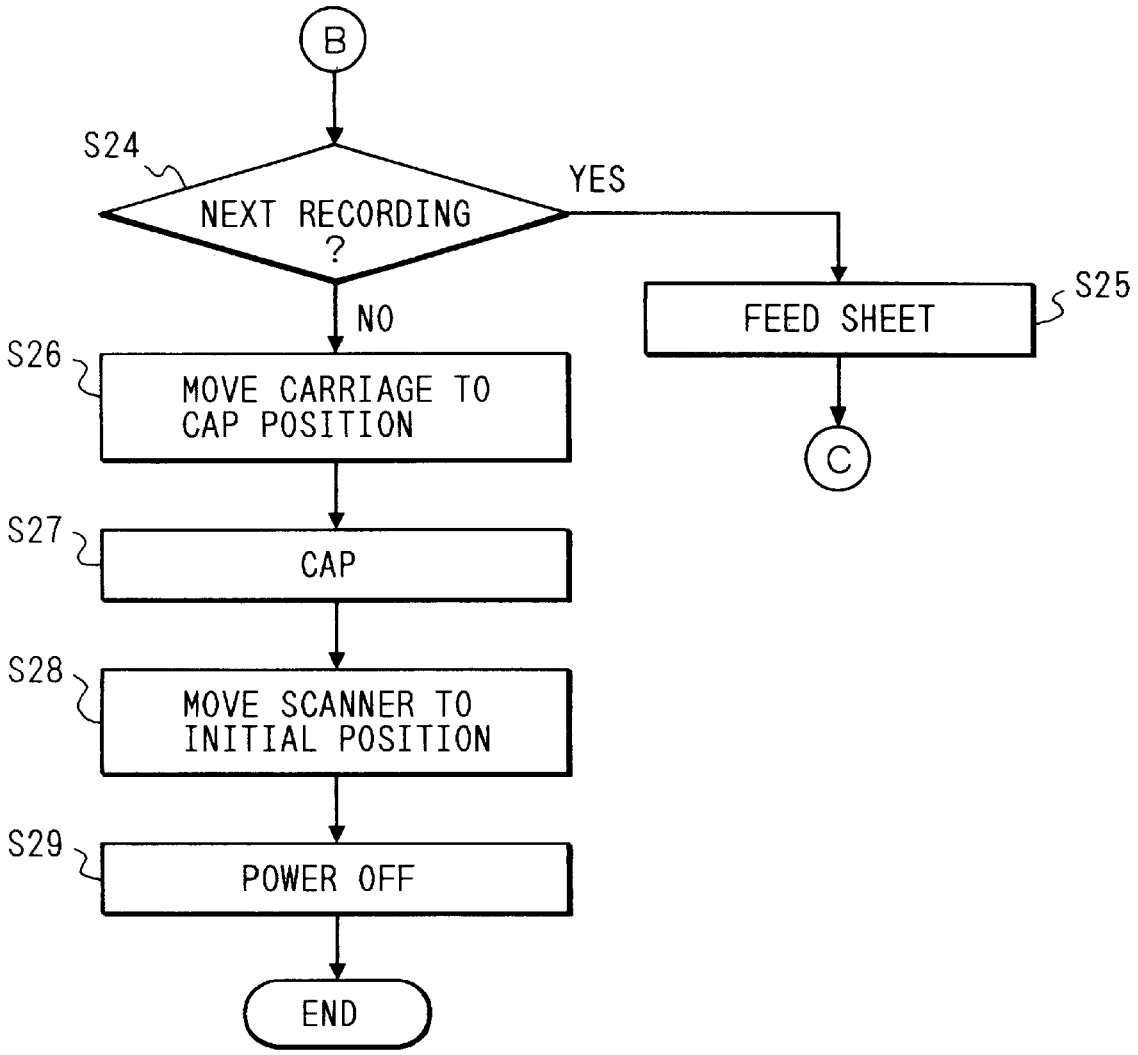

FIGS. 23A to 23D are front views showing the relation between the grip portion 236 of the black ink carriage 212, the gripper 262, and the black gripper 275, wherein the representation of the carriage 212 is omitted in the figure. FIG. 23A shows the state where the black gripper 275 restrains the carriage 238. The forked claw I of the black gripper 275 takes hold of the grip portion 236, and thus is opened outside. FIG. 23B shows the state where the scanner 258 comes closer to the carriage 212, the forked claw of the gripper 262 being about to enter the inside of the claw I of opened black gripper 275. FIG. 23C shows the state where the scanner 258 comes further closer thereto, the gripper 262 gripping the grip portion 236, the claw I of the black gripper 275 being further spread apart. Thereafter, if the scanner 258 is moved reversely as shown in FIG. 23D, the carriage 212 is scanned integrally with the scanner 258. Then, if the scanner 258 is further moved to the right once again, the carriage 212 is moved from the scanner 278 toward the black gripper 275, as opposed to the previous process. Thus, every time the scanner 258 approaches to the black gripper 275, the carriage 212 is transferred.

In FIG. 20, 277 is a cap for capping the recording head of the black ink cartridge 213 to protect it against drying. For the color ink cartridge 244, a cap, not shown, is also provided. The cap 277 comes into contact with the head face of the recording head in the black ink cartridge 213, when the black ink carriage 212 is in the cap position restrained by the black gripper 275 by cam means, not shown, and the cap 277 is retracted when the carriage 212 is unrestrained and leaves the black gripper 275.

The cap 277 is connected with the tube 103 as the flexible member in communication with the interior of the cap 277. The tube 103 is made of a material such as rubber or soft resin which is capable of elastic deformation, and extends in parallel to the scan direction over the lower portion of the roll 101. For the color ink cartridge 244, a cap and a tube 104, not shown, are also provided.

Next, the operation will be described below with reference to FIGS. 20 and 24A to 24C.

Prior to the power on, the scanner 278 stands still 50 mm left from a position where the light shielding plate 266 shields the optical path of the home position sensor 274 in the figure, while the black ink carriage 212 and the color ink carriage 238 are in the respective cap positions, their cartridges 213, 244 are capped, and the roll 101 is held at the first position.

If the power is turned on, the scanner 278 will move 100 mm to the right toward the black ink carriage 212 (Bk) (steps S1, S2). Then, the number of times that the optical path of the home position (HP) sensor 274 is shielded is judged, and if it is one, the scanner 278 is reversely moved to the left (step S5), and stops at a 50 mm position (hereinafter referred to as an initial position) after the optical path of the sensor 274 is shielded again (step S6). On the other hand, if the optical path of the sensor 174 is shielded twice, it is determined that the scanner 278 is connected to either the black ink carriage 212 or the color ink carriage 238, and further the on/off timing of the sensing signal of the sensor 274 is judged. Herein, there is a gap of 20 mm between the shielding plate 266 and the shielding plate 279 in the state where the scanner 278 and the carriage 212 are connected, while there is a gap of 6 mm between the shielding plate 266 and the shielding plate 280 in the state where the scanner 278 and the carriage 238 are connected. Accordingly, it is judgeable which of the carriages 212, 238 is connected to the scanner 278 at the timing of shielding the optical path of the sensor 274.

When the black ink carriage 212 (hereinafter referred to as "Bk carriage" or "black carriage") is connected, the black ink carriage 212 is moved to the cap position after the shielding plate 266 passes by the sensor 274 (step S4, S11). After the carriage 212 is restrained by the black gripper 275, the scanner 278 is reversely moved to the left (step S5), and after the optical path of the sensor 274 is shielded again, the carriage 212 is stopped at the initial position (step S6). On the other hand, when the color ink carriage 238 is connected, it is reversed at a 50 mm right position after the shielded plate 266 passes by the sensor 274, and moved to the left (step S9). And the color ink carriage 238 (also referred to as a color carriage) is moved to the cap position (step S10). After the color carriage 238 is restrained by the color gripper 273, the scanner 278 is reversed again (step S5), and stopped at the initial position (step S6).

In this way, in the state where neither of the carriage 212, 238 is connected to the scanner 278, the scanner 278 is only moved and stopped at the initial position, or when the carriage 212 or 238 is connected to the scanner in the power-off state by any unforeseen accident, the carrier 212, 238 is brought to the corresponding cap position and restrained, and then the scanner 278 alone is moved to the initial position and stopped therein.

If a recording signal is input, the recording signal is discriminated to see if it is for the black recording mainly such as the text or ruled line or a color image signal (step S7, S8), wherein in the former case the scanner 278 is scanned to the cap position of the black carriage 212 and integrated with the black carriage 212 (step S16), while in the latter case the scanner 278 is scanned to the cap position of the color carriage 238 and integrated with the color carriage 238 (step S13). At the same time, the cap is retracted from the cartridge 213 or 244 used for the recording (step S17, S14). In the recording with the black carriage 212, the recording occurs through 128 nozzles, and if the recording occurs for one scan (step S18), the paper 209 is fed by 128 nozzles (step S19, S23), and the next recording is effected (step S18). If the recording for one page is terminated, the paper is exhausted (step S19, S20), and if the recording is continued, a new paper is fed (step S24, S25). If the recording is terminated, the scanner 278 is moved until the black carriage 212 comes to the cap position (step S26), and after the black carriage 212 is restrained by the black gripper 275, and capped with the cap 277 (step S27), the scanner 278 is scanned to the position at the power-off, and stopped (step S28). Then, the power is turned off (step S29). On the other hand, the recording with the color carriage 238 occurs by color superimposition in the order of black, cyan, magenta and yellow, by feeding the paper 24 nozzles, in the areas with a greater percentage of color image, while the recording occurs using 64 black nozzles in the area of black image, by feeding the paper 64 nozzles (step S22).

Figure 28:
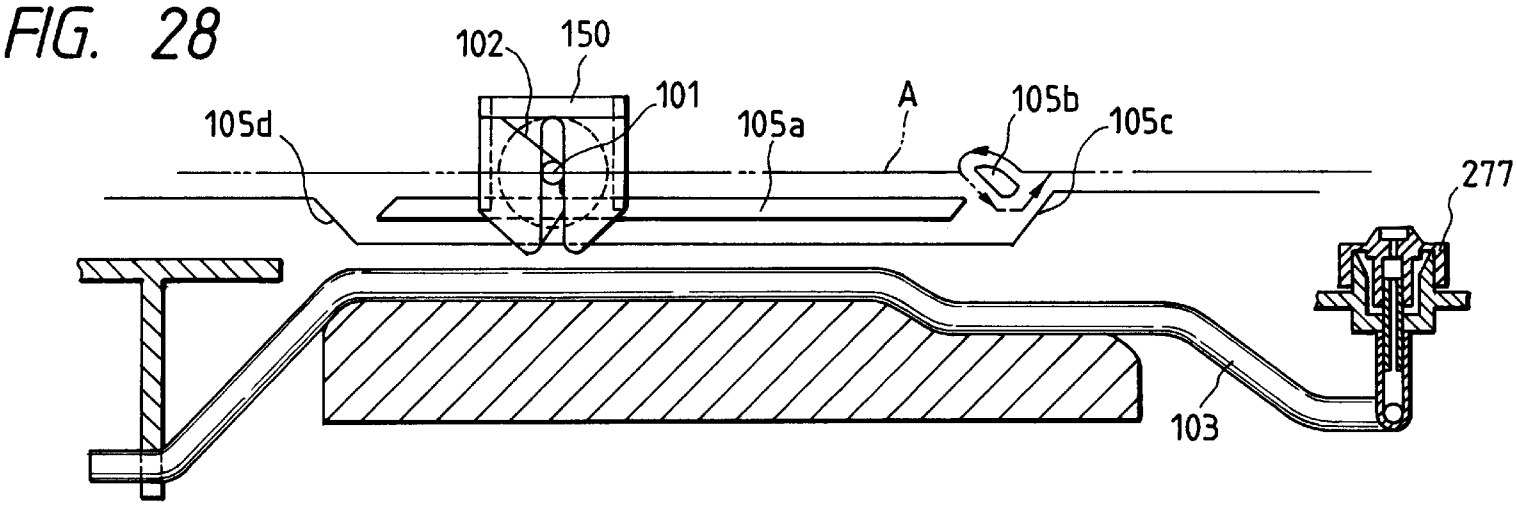
FIG. 28 is a front view of the essence in the state where the roll as shown in FIG. 26 is not involved in the pumping operation.

The relation between the roll 101 and the cam 105 is shown in FIG. 28. The cam 105 consists of cam portions 105*a*, 105*b*, 105*c*, 105*d*, as shown in the figure, the two-dot chain line of symbol A representing a motion locus around the center of the roll 101 when the pumping is not performed. The roll 101 as shown in the figure is in the state before the power is turned on, which normally occurs in the movement region for making the printing above a cam portion 105*a* in the horizontal direction, and at a first position which is located upwardly in the vertical direction, wherein there is a slight clearance between the upper face of the cam 105*a* and the roll shaft 101*a*. From this state, if the scanner 278 is moved to the right toward the cap 277, the roll shaft 101*a* abuts against the cam portion 105*b* upon going out of the scanning range necessary for the printing, so that the roll 101 moves to a second position along the arrow pointing to the right down direction. Further, if the scanner continues to move in a direction toward the cap 277, the roll 101 returns to the first position owing to the cam portion 105*c*, and the roll 101 stops at a position directly opposed to the cap 277. If the scanner 278 is reversed and moved to the left, the roll 101 is lifted up by the cam portion 105*b*, but thereafter is moved back to the first position again by the leaf spring 102. Further, if the scanner 278 continues to move in a reverse direction, the roll 101 undergoes a bilateral symmetrical motion with respect to that as above described owing to a cam, like the cam 105 provided on the color ink carriage 238. Accordingly, as long as the scanner 278 scans over the cam portion 105*b* in one direction, the roll 101 does not make contact in any way with the tube 103. Also, since the cam 105*b* and the roll 101 are contacted outside the printing area, there is nothing which makes contact with the roll 101 during the printing, and the cam portion 105 has no effect on the printing. Note that the cam 105*b* may be provided within the printing area as far as it does not adversely affect the printing.

Figure 29:
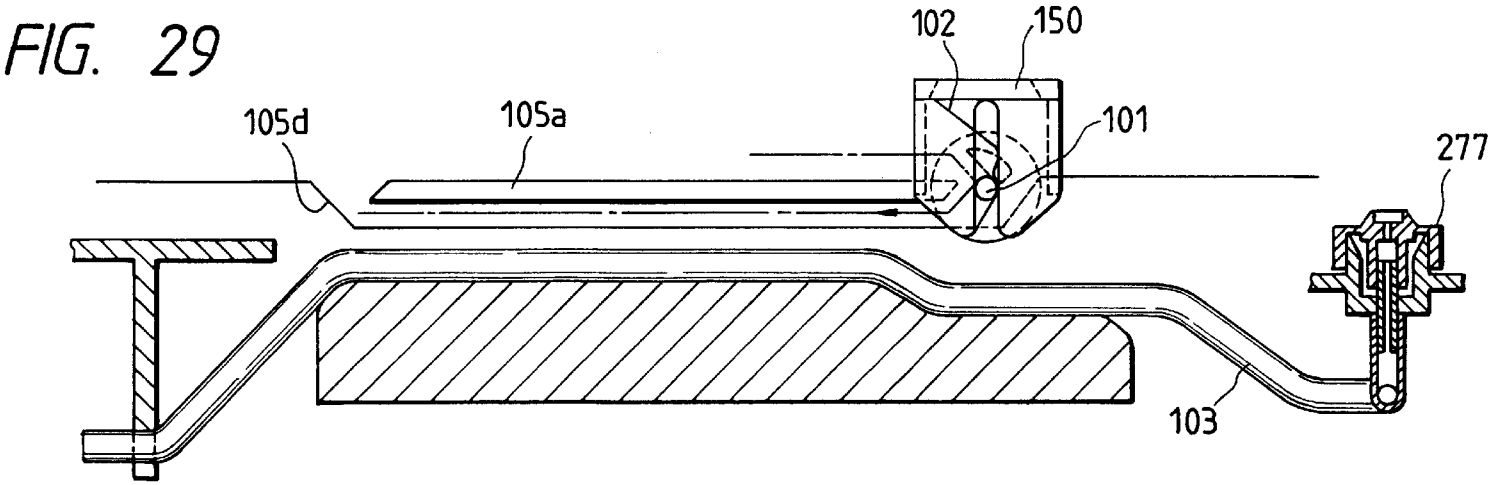
FIG. 29 is a front view of the essence in the state where the roll as shown in FIG. 26 starts the pumping.

Next, the operation of pumping will be described below. FIG. 29 shows the state where the roll 101 is moved to a lower second position by the cam portion 105*b*. From this state, if the scanner 278 is moved in the left direction, the roll 101 is forced down from the second position to a further lower third position by the cam portion 105*a*. The roll 101 is guided beneath the cam portion 105*a* to abut against the tube 103 and squeeze it. The tube 103 has a squeezed portion in the air tight condition, so that if the roll 101 is moved in the left direction at the lower third position, a negative pressure occurs within the tube lying to the right from the roll. Note that the roll 101 at the third position is never left off because it is located on a horizontal guide surface continuing to the cam portions 105*c*, 105*d* beneath the cam portion 105*a*. If the black ink cartridge 213 is capped beforehand, and the pumping is affected, a negative pressure is applied to the nozzles of the black ink cartridge 213, so that the ink within the nozzles is compulsorily expelled until the negative pressure is gone. After expelling the ink, the roll 101 returns to the first position owing to the cam portion 105*b*. Thereafter, the scanner 278 and the black ink carriage 212 are coupled to effect pumping likewise. At this time, since the cap is open to the atmosphere, every time the tube 103 is stroked by the roll 101, the ink within the cap 103 is moved to the left. If such atmosphere open suction is performed several times, all the ink sucked within the tube is expelled from the left end. When the ink is expelled from the color ink cartridge 244, the operation is exactly the same as above, although it is only reversed left and right.

In this example, the roll 101 is displaced at three stages between three positions, i.e., first, second and third positions, wherein when the roll is moved left and right at the third position, it strokes the tube 103 to effect pumping, but it should be noted that the roll may be displaced at two stages between two positions, i.e., first and second positions, whereby when the roll is moved left and right at the second position, it strokes the tube 103 to effect pumping. However, in that case, it is necessary to form the cam portion 105*b* of larger size in order to displace the roll 101 largely enough by the cam portion 105*b*. As in this example, when the roll 101 is displaced at three stages by the cam portions 105*a*, 105*b*, it is possible to displace the roll 101 sufficiently and smoothly by means of the cam portions 105*a*, 105*b*.

By the way, when the ink is expelled, the filters within the nozzles and the ink cartridge work as the flow resistance, and it usually takes about one to three seconds until the completion of ink discharging. Thus, if the roll 101 is moved left at high speed, and stopped directly before the roll 101 becomes out of engagement with the left end of the cam portion 105*a*, thereby waiting for the completion of ink discharge, a greater negative pressure will occur, favorably for the removal of dirt adhering to the nozzles and the removal of thickened ink due to drying. Further, the amount of expelling the ink can be controlled by disengaging the roll 101 out of the left end of the cam portion 105*a* during the expelling of ink, but without waiting for its completion.

In this example, since a tube pump is used, and a selector for selecting whether to effect pumping is comprised of the roll 101 itself which strokes the tube 103, the pump means can be constructed with less number of parts and cheaply.

Also, since the tube 103 is disposed in parallel to the scan direction near the scanner 278, and the pumping is effected using the movement region for the normal printing, a long enough tube can be efficiently laid out, and the stroke of squeezing the tube 103 can be sufficiently obtained.

By the way, owing to a spring nature of the forked claw of the gripper 262, it is not easy to separate the scanner 278 and the carriage 212, 238. However, since both may be possibly separated upon an event that the user touches them with hands, it is monitored whether the optical path of the sensor 274 is shielded twice at a predetermined timing during one scan of the scanner 278. If it is shielded only once, it is judged that the scanner 278 and the carriage 212 or 238 are separated, whereby the scanner 274 is stopped and a relief sequence is entered. Where the recording operation continuously occurs with the black carriage 212 immediately before its judgement, the scanner 278 is moved to the right by the amount of roughly 350 mm. During its movement, the gripper 262 comes into contact with the grip portion 236, directly pressing the black carriage 212 and moving it to the right. Thereafter, the grip portion 236 makes contact with the forked claw I of the black gripper 275, so that the grip portion 236 is gripped by the black gripper 275. Further, if the scanner 278 is moved to the right, the claw of the gripper 262 gets into the inside of the claw I of the black gripper 275. The carrier motor 271 steps out by an excess amount of movement, and stops. Then, the scanner 278 is reversed and moved to the left, together with the black carriage 212, and after passing by the sensor 274, it is stopped at the initial position. At the same time, the platen roller 203 is rotated to exhaust the sheet, and a new sheet 209 is supplied to prepare for the next recording. On the other hand, where a recording operation occurs with the color carriage 238 immediately before the previously-mentioned judgement, the scanner 278 is moved left 350 mm. The latter process is identical to that of the relief of the black carriage 212 as above described. In this way, even if the scanner 278 and the carriage 212 or 238 are separated apart upon an unforeseen event, the relief sequence is automatically carried out to enable the recording operation.

As above described, in this example, a suitable carriage is selected, depending on the kind of recording signal, to effect the recording. Such selection may be effected in accordance with the operation mode of the recording apparatus. Also, in this example, the recording head for the color ink cartridge 244 used is a head having the nozzles of different colors arranged longitudinally, which head has a smaller width than in the lateral arrangement, and therefore has the effect that the whole apparatus can be made compact.

In this example, because the first and second standby positions where the carriages 212, 238 are held are provided apart at both ends in the scan direction of the scanner 278, the carriage 212 can be simply attached to or detached from the scanner 278 only by causing the scanner 278 to scan in one direction or the other direction, whereby the whole apparatus can be further simplified and miniaturized.

As will be clear from FIG. 25, in the coupled state between the scanner 278 and the carriage 212, the intermediate portion to the left and right of the scanner 278 is contained within a projection space of the carriage 212 in a direction perpendicular to the scan direction of the scanner 278, namely within a projection space of the carriage 212 in the front-to-back direction of the paper face in FIG. 25. As previously described, a belt stop 264 (see FIG. 20) as the receiving portion of the driving force of the scanner 278 is disposed intermediately in the left and right directions of the scanner 278, so that the belt stop 264 naturally interposes within the projection space of the carriage 212. This results in a shorter distance between the belt stop 264 for receiving the driving force and the gravitational center of the carriage 212, thereby serving to suppress the moment occurring between the belt stop 264 and the bearing 268, 269 upon scanning of the scanner 278, together with the carriage 216, which is advantageous for making their scannings smoother. Since the gripping position between the gripper 262 and the grip portion 236 is also located within the projection space of the carriage 212, the occurrence of the swinging motion of the carriage 216 can be suppressed upon scanning of the carriage 216, together with the scanner 278. This is also the case when the scanner 278 and the carriage 238 are coupled. And because the intermediate portion to the left and right of the scanner 278 can be selectively used as respective occupation spaces of both carriages 212, 238, the scanner 278 can be reduced in size in the left and right directions thereof.

Further, when the scanner 278 and the carriage 212 are coupled, it is preferable that the gripper 262 and fitting shafts 259, 261, 263 on the scanner 278 side, and the grip portion 236 and fitting holes 234, 233, 235 on the carriage 212 side, should be preset with the positional relation thereof so as to have a fitting sequence as follows. First, the fitting hole 235 which is a long hole and the fitting shaft 263 are fitted to position the carriage 212 in the front-to-back direction of the paper face in FIG. 25, then the fitting holes 234, 233 and the fitting shaft 259, 261 are fitted to position the carriage 212 in the vertical direction of FIG. 25, and thereafter or at the same time, the gripper 262 is caused to grip the grip portion 236. In this way, for the drawable/releasable engagement of the carriage 212 with the scanner 278, it is favorable that the carriage 212 is positioned before the gripper 262 grips the grip portion 236, to regulate the relative positional relation between the carriage 212 and the scanner 278, in the respect of assuring such drawable/releasable engagement. Also, this is the case as well with the coupling between the scanner 278 and the carriage 238. Note that in FIG. 20, the fitting shafts 260, 261, 263 and the gripper 262 on the scanner 278 side are referenced with symbols A, B, C, D, and the fitting holes 240, 239, 241 and the grip portion 243 on the carriage 238 side correspondingly are referenced with symbols E, F, G, H.

While in this example the ink cartridges 213, 244 are mounted on the carriages 212, 238, it will be appreciated that the cartridge 213, 244 or the recording head as such may be transferred by the scanner 278, and selectively coupled to the scanner 278, without provision of the carriages 212, 238. Also, while in this example, means for coupling the carriages 212, 238 with the scanner 278 and means for restraining them to the cap position were a gripper 262 having a forked claw made of resin, it will be appreciated that they are not limited thereto, and coupling/separating means may be also encompassed as implementable means, including, for example, a system of opening and closing the forked claw, using a solenoid, and a system of utilizing the suction force between an electromagnet and the metal.

Also, the functional element is not specific in any way to the recording head alone, but for example, an image reading sensor may be provided as the functional element to constitute an image reading device. Also, one of the carriages 212, 238 may be a carriage dedicated for the ink jet recording head, the other being a carriage dedicated for the image reading head. The carriages 212, 238 may be identical, with one of them as the reserve. As the functional element, an image reading head having different resolutions of 300 dpi, 350 dip, 600 dpi, 720 dpi, for example, may be replaceably provided, or a recording head capable of discharging different kinds of the ink, for example, a recording head for the discharging of dense black ink, for the discharging of yellow, magenta and cyan inks, for the discharging of yellow, magenta, cyan and black inks, or for the discharging of light black ink may be replaceably provided. Of course, the recording head may be in any of various forms including a thermal head.

Further, an auto-changer to selectively move a plurality of functional elements may be provided at a site on the end portion of the scanner 278 in the scan direction, and with its auto-changer, the functional element moved to that site may be coupled with the scanner 278.

<Seventh Example>

FIGS. 30 to 33 are views for explaining a seventh example of the present invention.

In this example, the relation between a scanner 278 and the carriages 212, 238, and the feeding mechanism of the recording sheet 209, are the same as those of the sixth example as heretofore described, wherein like parts are referenced with like numerals, and therefore this example will be only described in connection with different portions.

Figure 30:
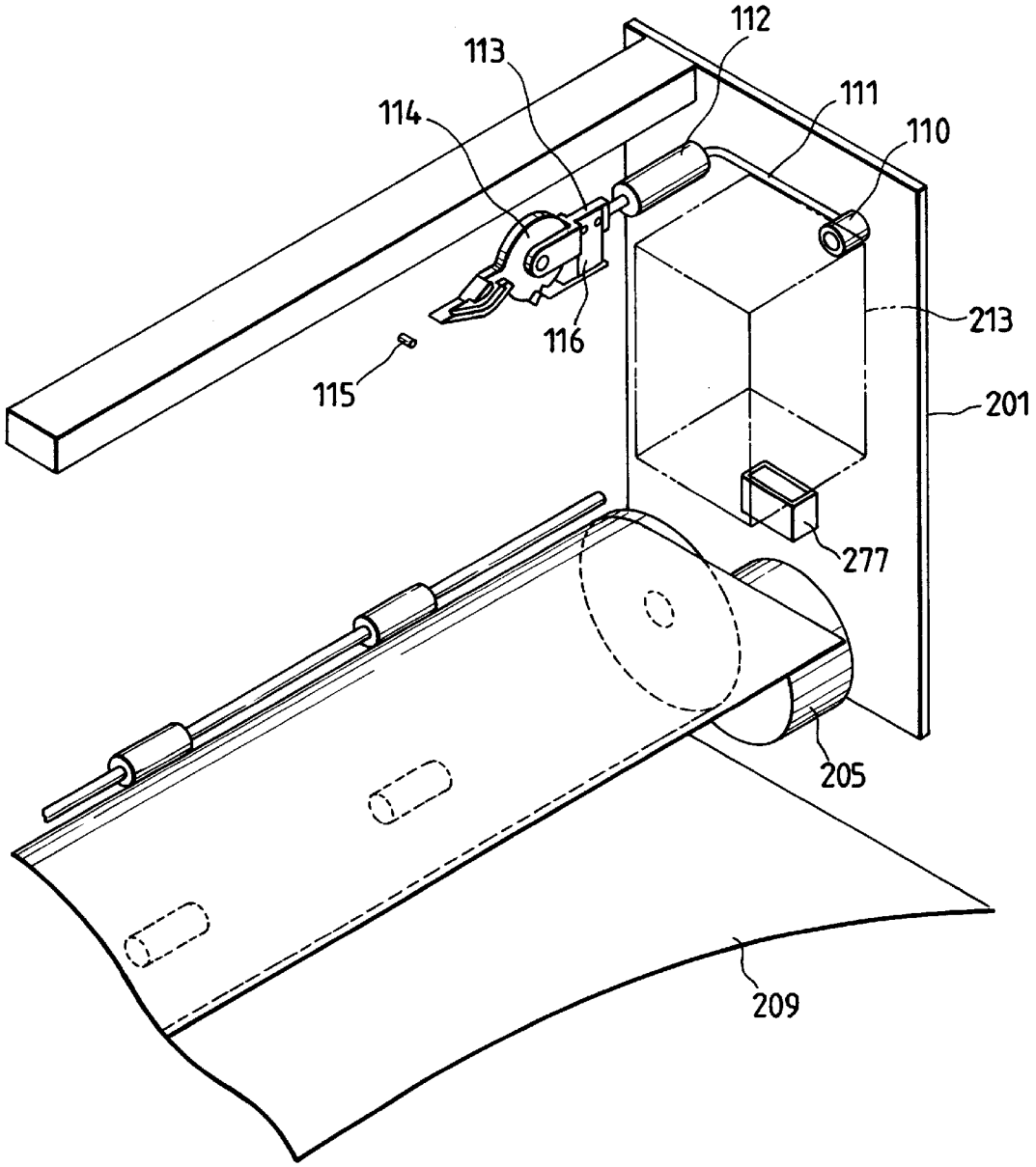
FIG. 30 is a perspective view of the essence of an ink jet recording apparatus based on a seventh example of the present invention.

FIG. 30 is a perspective view showing the essence of an ink jet recording apparatus according to the present invention. When a black ink cartridge 213 is capped with a cap 277, a pressure cap 110 molded of an elastic material and secured to a side plate 201 is pressed against the side face of the black ink cartridge 213. On the side face of the black ink cartridge 213, there is an opening, not shown, at a position corresponding to the pressure cap 110, whereby a pressure applied into this opening presses the liquid face of the ink provided inside, to discharge the ink from the nozzles. 121 is a pressure pump, wherein if a slide arm 113 is moved to the right in the figure, a positive pressure will occur, and the pressure pump comes in communication with the pressure cap 110 via a communicating pipe 111. Such pressure pumps are generally well known, including, but not specifically limitative to in this example, a combination of a bellows and a one-way valve, and a piston type. The slide arm 113 has a leaf spring 116 secured, with a selector 114 rotatably supported and urged to the left in the figure by a spring, not shown. 115 is a dowel extending upward from the scanner 278, which is omitted in this figure.

Figure 31:
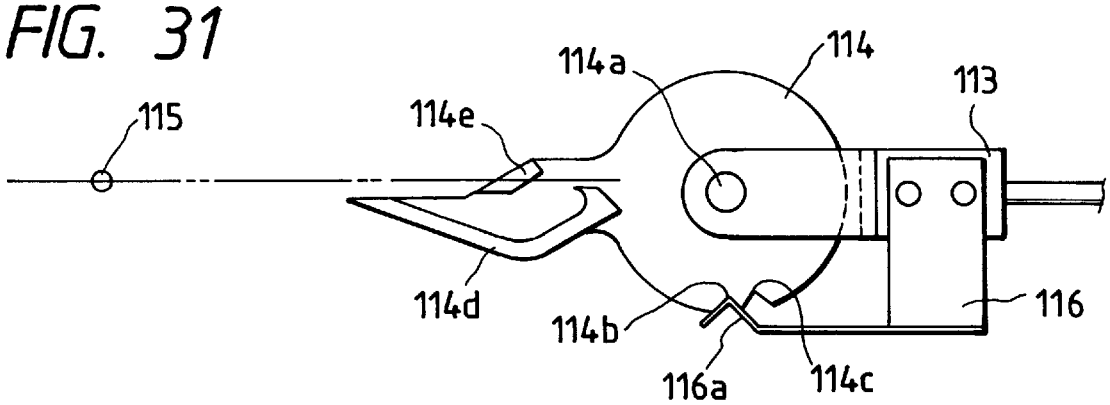
FIG. 31 is a plan view for explaining one operation state of a selector as shown in FIG. 30.
Figure 32:
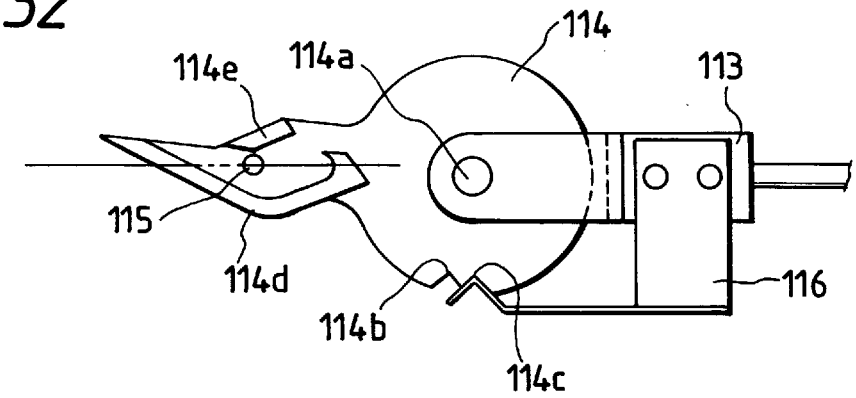
FIG. 32 is a plan view for explaining another operation state of the selector as shown in FIG. 30.
Figure 33:
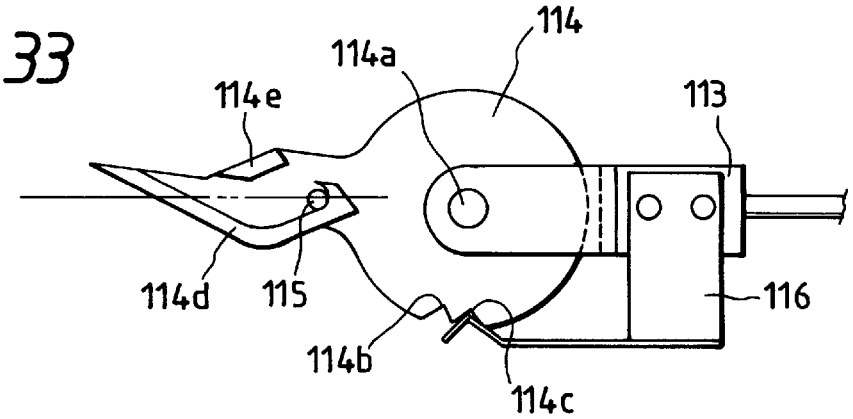
FIG. 33 is a plan view for explaining a further state of the selector as shown in FIG. 30.

Referring now to FIGS. 31, 32 and 33, the operation of the selector 114 will be described below. The selector 114 is rotatable around a center 114*a*, and is stable in an attitude as shown, because of a bend 116*a* of the leaf spring 116 engaging a notch 114 in FIG. 31, of two notches 114*b*, 114*c*. The position as shown in FIG. 31 corresponds to the first position of the selector in the sixth example. Also, the selector 114 has two cams 114*d*, 114*e* which can force their way into the motion locus of the dowel 115. If the dowel 115 in the printing area is moved to the right out of the printing area, the dowel 115 comes into contact with a cam 114*e* of the selector 114 out of the printing area, and presses down the cam 114*e* along the slant surface. The selector 114 is rotated in a counterclockwise direction, but is returned to the first position by the leaf spring 116 at the moment when the dowel 115 gets out of engagement with the cam 114*e* of the selector 114. Thereafter, if the dowel 115 is moved from the right of the selector 114 to the left thereof, it comes into contact with the upper side at the right end of the cam 114*d* of the selector 114 to rotate the selector 114 in the counterclockwise direction, but is returned to the first position again by the spring 116, upon passing therethrough. Then, the dowel 115 comes into contact with a right lower slant surface of the cam 114*e* of the selector 114, to rotate the selector 114 in a clockwise direction at this time, resulting in a state of FIG. 32. Then, since the leaf spring 116 is engaged in a notch 114*c* of the selector 114, the selector 114 becomes stable in the shown state. This state corresponds to the second position of the sixth example as previously described. Thereafter, if the dowel 115 is moved to the left, it comes into contact with the left end of the cam 114*d* of the selector 114 to rotate the selector 114 in the counterclockwise direction to return the dowel 115 to the first state. From the state of FIG. 32, if the dowel 115 is moved to the right, the dowel 115 and the cam 114*d* of the selector 114 are meshed, as shown in FIG. 33. Further, if the dowel 115 is moved to the right, the slide arm 113 is moved to the right to produce a positive pressure in the pressure pump 112. If the discharging of the ink from the nozzles is terminated, the dowel 115 is moved in the right direction. The slide arm 113 is slid to the left by a spring, not shown, and the selector 114 is rotated in the counterclockwise direction by the dowel 115 abutting against the left end of the cam 114*d*, thereby returning to the first position. Then, if the dowel 115 is moved to the left again before the selector 114 returns to the first position, the slide arm 113 is also moved to the left, so that multiple pumpings can be consecutively effected.

While in this example the use of an ordinary pump was made, it will be understood that the overall length of a pump itself can be shortened by increasing the diameter of a pump chamber, resulting in an effect of having a smaller installation space than the sixth example as previously described.

Also, while in this example the use of a pump for producing positive pressure was made, it will be understood that a pump for producing negative pressure can be used to provide a communicating pipe in communication with a cap 277, while attaining the exactly same effect.

<Eighth Example>

Figure 34:
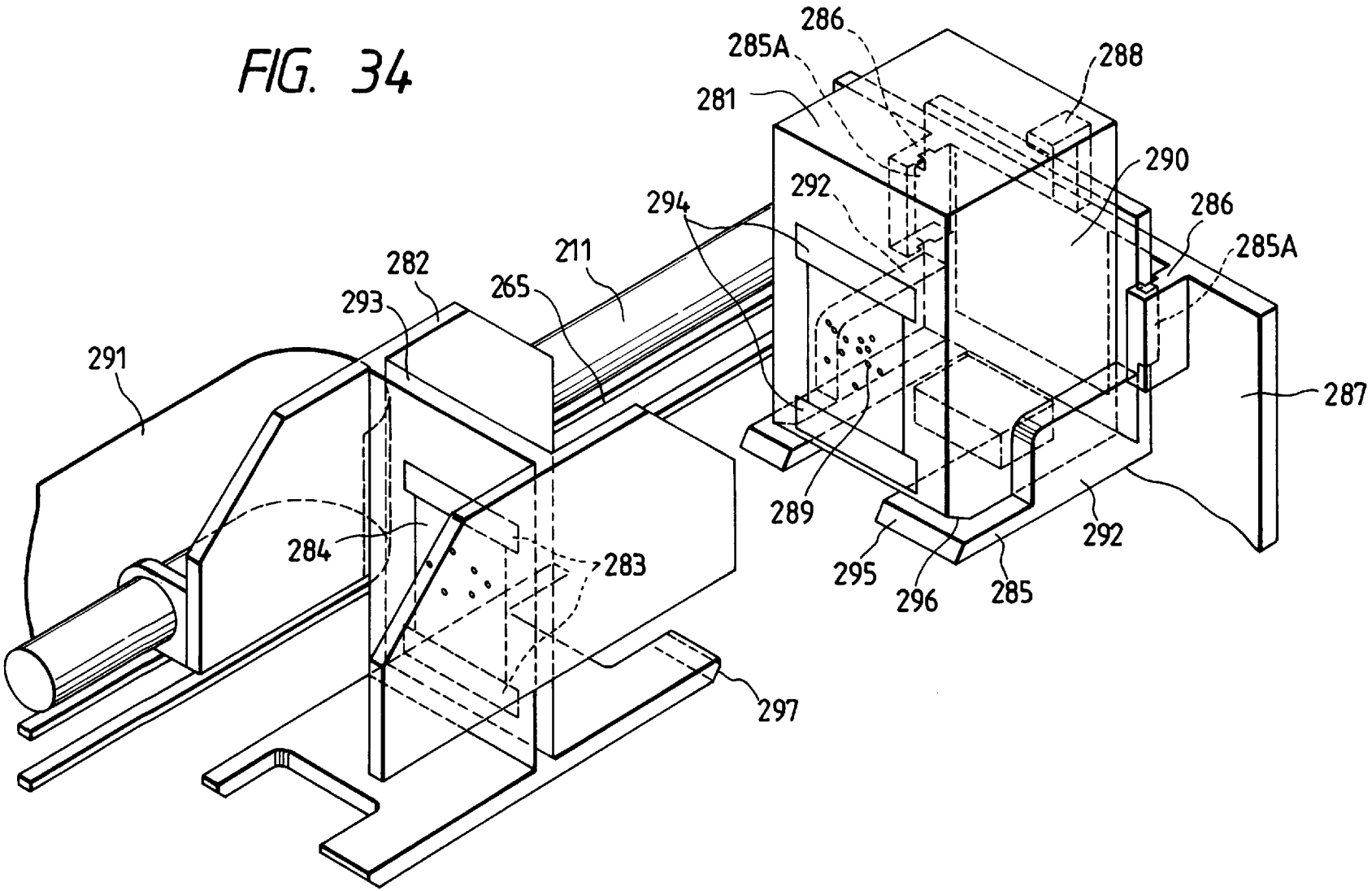
FIG. 34 is a perspective view of the essence of an ink jet recording apparatus based on an eighth example of the present invention.

In FIG. 34, 281 is a black ink cartridge constituted similarly to the black ink cartridge 213 in the sixth example as previously described. This cartridge 281 is laid on the upper portion of a cartridge stacker 285. A taper portion 296, contacted by a scanner 282 as the carrier described below, is formed on the lower portion of the black ink cartridge 281. The cartridge stacker 285 is provided with a magnet 290, which can attract an iron plate, not shown, provided on the surface of the black ink cartridge 281. Also, the cartridge stacker 285 is provided with the guides 292 to sandwich a cartridge 281 therebetween to position the cartridge 281.

Provided on both sides of the cartridge stacker 285 are ribs 285A, which are fitted into grooves 286 formed on a side plate 287. The cartridge stacker 285 is slidable up and down along the grooves 286. The cartridge stacker 285 is urged upward by urging means, not shown, and abutted against and stopped by a stopper 288 extending outwards from the side plate 287. Also, the stacker 285 is formed with a taper portion 295 contacted by the scanner 282 described below.

282 is a scanner as the carrier, which is supported on the guide shaft 211 and is scannable in the axial direction of the guide shaft 211 by the belt 265. The scanner 282 has a shape of axial symmetry with respect to an intermediate wall 293 as the boundary. 284 is a contact point portion, its contact points lying on both sides of the intermediate wall 293, left and right. The contact points of the contact point portion 284 and the contact points provided on the side face of the black ink cartridge 281 are located correspondingly, and upon contact of both, a recording signal is sent through a flexible cable 291 to the black ink cartridge 281. 283 is an electromagnet embedded into the intermediate wall, from which an on/off signal of electromagnetic force is sent via the flexible cable 291. If its electromagnetic force is turned on, it can pull and fix the iron plate 294 provided on the cartridge 281. At the same time, good electrical contact between the contact point portion 284 and the contact points takes place owing to a pulling force at that time. 297 is a taper portion on the scanner 282 which can make contact with a taper portion 295 on the cartridge stacker 285. Like the sixth example as previously described, a color ink cartridge, not shown, is laid on a cartridge stacker, not shown, on the opposite side of the black ink cartridge 281 in the main scan direction. In operation, the black recording with the black ink cartridge 281 and the color recording with the color ink cartridge are equivalent, and therefore the black recording will be only described below.

First, if the power is turned on, the scanner 282 is moved to the initial position, as in the sixth example as previously described. If a recording signal is input, a determination is made whether the recording signal is for the black recording or the color recording, whereby the scanner 282 is moved toward a corresponding ink cartridge. In the case of black recording, when the scanner 282 is moved toward the black ink cartridge 281, the taper portion 297 of its scanner 282 and the taper portion 295 of the cartridge stacker 285 are contacted, so that the stacker 285 falls down, and the taper portion 297 of the scanner 282 enters between the taper portions 295, 296. And the cartridge 281 is moved on the upper portion of the scanner 282. If the electromagnet magneto 283 is turned on at the point when the contact between the contact points 284, 289 occurs, the cartridge 281 is secured onto the scanner 282. Since the attraction force of the electromagnet 283 is stronger than that of a magnet 290, if the scanner 282 moves away from the stacker 285 in this state, the cartridge 281 is also moved together with the scanner 282. In this way, after the scanner 282 and the cartridge 281 are integrated, the recording operation takes place as in the sixth example.

In this example, because one flexible cable 291 can be commonly used for both the black ink cartridge 281 and the color ink cartridge, there is an effect that the constitution of the apparatus can be simplified. Also, since the ink cartridge is directly attached to or separated from the scanner 282, the capacity of ink can be increased by the weight of the carriage, as compared to the sixth example as previously described, so that the ink cartridge with a greater capacity can be employed for the recording. As a result, the running cost is lower, and the replacement of cartridge is less troublesome.

(Embodiments of the Present Invention)

The embodiments of the present invention involve the equipment with scan-type carriers in the form of (1) to (13) as follows.

(1) An equipment with a scan-type carrier of the first form having the scan-type carrier for scanning with a driving force received and a guide mechanism for allowing for the scanning of said scan-type carrier, characterized by comprising a first standby region where a functional element can be held at one end with respect to a scan direction, and a second standby region where the functional element can be held at the other end, the guide mechanism enabling the scan-type carrier to be moved between the first standby region and the second standby region, the scan-type carrier being movable together with the functional element lying on at least one of the first standby region and the second standby region.

(2) An equipment with a scan-type carrier of the second form, characterized by comprising, in the above first form, a functional element mounting carriage having an electrical contact point for enabling the functional element to function and a mechanism for positioning the functional element at each of the first and second standby regions, wherein the scan-type carrier has the functional element mounting carriage laid to mount the functional element.

(3) An equipment with a scan-type carrier of the third form, characterized in that, in the second form, the functional element mounting carriage is swingably engaged in the guide mechanism, the first and second standby regions having a mechanism for regulating the swinging motion of the carriage, the scan-type carrier having an engagement mechanism for regulating the swinging of the carriage upon mounting the carriage.

(4) An equipment with a scan-type carrier of the fourth form, characterized in that, in the third form, the functional element mounting carriage receives an engagement with the scan-type carrier so that a driving force receiving portion of the scan-type carrier may intervene within a projection space of the carriage in a direction perpendicular to the scanning direction.

(5) An equipment with a scan-type carrier of the fifth form, characterized in that, in the fourth form, the functional element mounting carriage effect a regulating engagement for regulating the relative positional relation with the scan-type carrier, before receiving the drawable/releasable engagement with the scan-type carrier.

(6) An equipment with a scan-type carrier of the sixth form, characterized in that, in the first form, the scan-type carrier comprises an electrical contact point for enabling the functional element mounted to function and a mechanism for positioning the functional element.

(7) An equipment with a scan-type carrier of the seventh form, having the scan-type carrier for scanning with a driving force received and a guide mechanism for allowing for the scanning of the scan-type carrier, characterized by comprising a first standby region provided with a functional element mounting carriage on which the functional element can be mounted and held at one end with respect to a scan direction and which is swingably engaged in the guide mechanism and a mechanism for regulating this swinging motion, the guide mechanism enabling the scan-type carrier to be scanned between the first standby region and an information processing area on which the functional element operates, the scan-type carrier mounting integrally the functional element at the first standby region and having an engagement mechanism for regulating this swinging motion.

(8) An equipment with a scan-type carrier of the eighth form, having the scan-type carrier for scanning with a driving force received and a guide mechanism for allowing for the scanning of the scan-type carrier, characterized by having a first standby region provided with a functional element mounting carriage on which the functional element can be mounted and held at one end with respect to a scan direction and which is swingably engaged in the guide mechanism, and a mechanism for regulating this swinging motion, the guide mechanism enabling the scan-type carrier to be scanned between the first standby region and an information processing area on which the functional element operates, the scan-type carrier mounting integrally the functional element on the first standby region and having an engagement mechanism for regulating this swinging motion, and further the functional element mounting carriage receiving an engagement with the scan-type carrier so that a driving force receiving portion of the scan-type carrier may intervene within a projection space of the carriage in a direction perpendicular to the scanning direction.

(9) An equipment with a scan-type carrier of the ninth form, having the scan-type carrier for scanning with a driving force receiving and a guide mechanism for allowing for the scanning of the scan-type carrier, characterized by comprising a first standby region provided with a functional element mounting carriage on which the functional element can be mounted and held at one end with respect to a scan direction, the guide mechanism enabling the scan-type carrier to be scanned between the first standby region and an information processing area on which the functional element operates, the scan-type carrier mounting integrally the functional element in the first standby region, and the functional element mounting carriage receiving an engagement with the scan-type carrier so that a driving force receiving portion of the scan-type carrier may intervene within a projection space of the carriage in a direction perpendicular to the scanning direction.

(10) An equipment with a scan-type carrier of the tenth form, having the scan-type carrier for scanning with a driving force received and a guide mechanism for allowing for the scanning of the scan-type carrier, characterized by comprising a first standby region provided with a functional element mounting carriage on which the functional element can be mounted and held at one end with respect to a scan direction, the guide mechanism enabling the scan-type carrier to be scanned between the first standby region and an information processing area on which the functional element operates, the scan-type carrier mounting integrally the functional element in the first standby region, and the functional element mounting carriage effecting a regulating engagement for regulating the relative positional relation with the scan-type carrier, before receiving the drawable/releasable engagement with the scan-type carrier.

(11) An equipment with a scan-type carrier of the eleventh form, having the scan-type carrier and a guide mechanism for allowing for the scanning of the scan-type carrier, characterized by comprising a first standby position on which an ink jet head can be mounted at one end with respect to a scan direction, a second standby position on which the ink jet head can be mounted at the other end, a cap mechanism for acting on and capping the ink jet head at the first standby position, and a cap mechanism for acting on and capping the ink jet head at the second standby position, the guide mechanism enabling the scan-type carrier to be moved between the first standby position and the second standby position, and enabling the scan-type carrier to be moved integrally with the ink jet head located at either of the first standby position and the second standby position.

(12) An equipment with a scan-type carrier of the twelfth form having the scan-type carrier and a guide mechanism for allowing for the scanning of the scan-type carrier, characterized by comprising a first standby position dedicated for carriage on which an ink jet head can be mounted at one end with respect to a scan direction, a second standby position dedicated for carriage on which a functional element different from the ink jet head can be mounted at the other end, the guide mechanism enabling the scan-type carrier to be moved between the first standby position and the second standby position, and enabling the scan-type carrier to be moved integrally with a carriage located at either of the first standby position and the second standby position.

(13) An equipment with a scan-type carrier of the thirteenth form, characterized by comprising the scan-type carrier, a first standby position where a first functional element can be mounted at one end with respect to a scan direction, a second standby position where a second functional element can be mounted at the other end, a guide mechanism for enabling the scan-type carrier to be moved between the first standby position and the second standby position, and selection means for selecting the functional element located at either of the first standby position and the second standby position in accordance with an operation mode of the equipment or a functional element driving signal to allow integration with the scan-type carrier.

What is claimed is:

1. An ink jet recording apparatus comprising:

a carriage for mounting recording means for recording by discharging ink through discharge ports;

a carrier for moving said carriage, said carrier being for coupling with and separating from said carriage;

a cap, which is located at a predetermined position, for capping said discharge ports;

a flexible tube extending along a movement direction of said carrier in communication with said cap; and pressing means, provided on said carrier, for producing pressure changes within said cap by pressing said tube while said carrier, separated from said carriage, moves said pressing means along said tube and while said carriage is positioned adjacent said cap such that the discharge ports are capped by said cap, wherein the pressure changes within said cap cause suction through the discharge ports.

2. An ink jet recording apparatus according to claim 1, wherein said cap, said tube and said pressing means cooperate for recovering and maintaining a discharge condition of the ink through said discharge ports by producing the pressure changes to expel the ink into said cap through said discharge ports.

3. An ink jet recording apparatus according to claim 2, wherein said carrier causes the pressure changes in said cap when said carrier moves in one direction and ceases the pressure changes when said carrier moves in another direction.

4. An ink jet recording apparatus according to claim 2, wherein said recording means comprises heat energy generating means for generating heat energy for use in discharging the ink.

5. An ink jet recording apparatus according to claim 4, wherein said heat energy generating means comprises an electrothermal converter.

6. An ink jet recording apparatus according to claim 1, wherein said recording means comprises heat energy generating means for generating heat energy for use in discharging the ink.

7. An ink jet recording apparatus according to claim 6, wherein said heat energy generating means comprises an electrothermal converter.

* * * * *

UNITED STATES PATENT AND TRADEMARK OFFICE

CERTIFICATE OF CORRECTION

PATENT NO. : 5,917,513 Page 1 of 2

DATED : June 29, 1999

INVENTOR(S) : MIYAUCHI ET AL.

It is certified that error appears in the above-identified patent and that said Letters Patent is hereby corrected as shown below:

Title page, item

[56] References Cited:

FOREIGN PATENT DOCUMENTS, "3005160" should read --3-5160--.

"403246040" should read --3-246040--.

"5069558" should read --5-69558--.

COLUMN 2:

Line 53, "a" should be deleted.

COLUMN 7:

Line 61, "the" should read --a--.

COLUMN 9:

Line 49, "respectively" should read --respectively,--.

COLUMN 12:

Line 28, "to" should be deleted.

COLUMN 18:

Line 55, "the exactly" should read --exactly the--.

UNITED STATES PATENT AND TRADEMARK OFFICE

CERTIFICATE OF CORRECTION

PATENT NO. : 5,917,513 Page 2 of 2

DATED : June 29, 1999

INVENTOR(S) : MIYAUCHI ET AL.

It is certified that error appears in the above-identified patent and that said Letters Patent is hereby corrected as shown below:

COLUMN 19:

Line 47, "magneto" should be deleted.

COLUMN 20:

Line 43, "effect" should read --effects--.

Signed and Sealed this

Eleventh Day of January, 2000

*Attest:*

*Attesting Officer*

Q. TODD DICKINSON

*Acting Commissioner of Patents and Trademarks*